US011432689B2

(12) United States Patent
Miura

(10) Patent No.: US 11,432,689 B2
(45) Date of Patent: Sep. 6, 2022

(54) HOME TISSUE PAPER ACCOMMODATION CONTAINER

(71) Applicant: DAIO PAPER CORPORATION, Shikokuchuo (JP)

(72) Inventor: Akiteru Miura, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 17/280,714

(22) PCT Filed: Sep. 13, 2019

(86) PCT No.: PCT/JP2019/036154
§ 371 (c)(1),
(2) Date: Mar. 26, 2021

(87) PCT Pub. No.: WO2020/066703
PCT Pub. Date: Apr. 2, 2020

(65) Prior Publication Data

US 2021/0393092 A1 Dec. 23, 2021

(30) Foreign Application Priority Data

Sep. 28, 2018 (JP) ..... JP2018-183633

(51) Int. Cl.
*A47K 10/42* (2006.01)
*A47K 10/32* (2006.01)

(52) U.S. Cl.
CPC .... *A47K 10/421* (2013.01); *A47K 2010/3233* (2013.01)

(58) Field of Classification Search
CPC ..... A47K 10/421
(Continued)

(56) References Cited

U.S. PATENT DOCUMENTS 2,687,157 A 8/1954 Cowan
2005/0279756 A1* 12/2005 Bitowft ..... A47K 10/426 221/45

FOREIGN PATENT DOCUMENTS

JP H03097060 U 10/1991
JP H08230921 A 9/1996
(Continued)

OTHER PUBLICATIONS

International Search Report (ISR) (and English translation thereof) dated Nov. 5, 2019 issued in International Application No. PCT/JP2019/036154.

(Continued)

*Primary Examiner* — Gene O Crawford
*Assistant Examiner* — Ayodeji T Ojofeitimi
(74) *Attorney, Agent, or Firm* — Maier & Maier, PLLC

(57) ABSTRACT

A home tissue paper accommodation container includes a container body having an accommodation space. The container body includes a container body upper part and a container body lower part which are connected to each other by a connection part and integrally formed. The container body upper part and the container body lower part can be detachably combined with respect to each other so as to seal the accommodation space. The connection part connects surfaces oriented in the same direction in a state in which the container body upper part and the container body lower part are combined with each other. The connection part connects a position separated from the lower end of the container body upper part and a position separated from the upper end of the container body lower part to each other.

6 Claims, 15 Drawing Sheets

(58) Field of Classification Search
USPC ..... 221/33–63
See application file for complete search history.

(56) References Cited

FOREIGN PATENT DOCUMENTS

| | | | |
|---|---|---|---|
| JP | 2001270575 | A | 10/2001 |
| JP | 2007223621 | A | 9/2007 |
| JP | 2013245003 | A | 12/2013 |
| JP | 2016172581 | A | 9/2016 |
| KR | 20080075626 | A | 8/2008 |

OTHER PUBLICATIONS

Japanese Office Action (and English translation thereof) dated Feb. 2, 2021 issued in Japanese Application No. 2018-183633.
Written Opinion dated Nov. 5, 2019 issued in International Application No. PCT/JP2019/036154.
International Preliminary Report on Patentability (IPRP) (and English language translation thereof) dated Mar. 23, 2021 issued in International Application No. PCT/JP2019/036154.
Japanese Office Action (and English language translation thereof) dated Apr. 20, 2021 issued in Japanese Application No. 2018-183633.
Extended European Search Report dated May 9, 2022, in connection with corresponding European Application No. 19864691.1; 8 pages.
Office Action dated May 7, 2022 in corresponding Chinese Application No. 201980058191.8; 17 Pages including English-language translation.
Office Action dated Jul. 6, 2022 in corresponding Russian Application No. 2021108126; 13 pages including English-language translation.

* cited by examiner

HOME TISSUE PAPER ACCOMMODATION CONTAINER

TECHNICAL FIELD

The present invention relates to a home tissue paper accommodation container.

BACKGROUND ART

It is essential to be able to refill home tissue paper accommodated in an accommodation space inside an accommodation container for home tissue paper such as wet tissues. As a mechanism for the refilling, a container body having a removable bottom lid is known (for example, see JP 2016-172581 A).

SUMMARY OF INVENTION

In such a home tissue paper accommodation container, it takes a lot of time and effort to refill home tissue paper inside the container because it is necessary to lift the container, turn over the container, remove the bottom lid, fill the home tissue paper inside, attach the bottom lid, and turn over the container again.

Therefore, in order to make it easier to refill the internal home tissue paper, the container body of the home tissue paper accommodation container may have an upper container body and a lower container body that can be detachably assembled that are connected on the rear surface. As a result, it is possible to pivot the upper container body to open the container body at the middle thereof and to refill the accommodated home tissue paper inside the home tissue paper accommodation container while it is left still.

In this case, in order to improve the manufacturing efficiency, it is desirable that the upper part of the container body and the lower part of the container body are formed of a predetermined resin material integrally rather than formed separately and connected. However, it is difficult to integrally form them that are directly connected to each other considering the structure of a mold. Therefore, when manufactured on a mold, it is necessary that there is a certain gap between the upper part of the container body and the lower part of the container body, and that a connection portion is arranged between them.

However, when formed in this way, the connection portion protrudes to the outside of the container body and stands out during use of the home tissue paper accommodation container. This may cause deterioration of the appearance of the container and the like.

An object of the present invention is to provide a home tissue paper accommodation container in which a container body includes an upper container body and a lower container body that can be detachably assembled. According to the home tissue paper accommodation container, even when the upper container body and the lower container body are integrally formed, the connection portion of the upper container body and the lower container body protrudes a little.

One aspect of the invention is a home tissue paper accommodation container which includes a container body that has an accommodation space that accommodates home tissue paper inside. The container body includes an upper container body that forms an upper part of the container body and a lower container body that forms an lower part of the container body. The upper container body and the lower container body are integrally formed and connected by at least one connection portion and are detachably assembled, thereby closing the accommodation space. The connection portion connects respective surfaces of the upper container body and the lower container body, the surfaces facing in the same direction when the upper container body and the lower container body are assembled. In addition, the connection portion connects to the upper container body at a portion separated from a lower edge of the upper container body when the upper container body and the lower container body are assembled, and the connection portion connects to the lower container body at a portion separated from an upper edge of the lower container body when the upper container body and the lower container body are assembled. With this structure, a home tissue paper accommodation container can be provided in which a container body includes an upper container body and a lower container body that can be detachably assembled. Even when the upper container body and the lower container body are integrally formed, the connection portion of the upper container body and the lower container body protrudes only a little.

The connection portion can have a length that is substantially the same as a total of (i) a distance between a portion at which the connection portion connects to the upper container body and a lower edge of the upper container body when the upper container body and the lower container body are assembled and (ii) a distance between a portion at which the connection portion connects to the lower container body and an upper edge of the lower container body when the upper container body and the lower container body are assembled. With this structure, the connection portion protrudes even less during use.

The connection portion can include a plurality of connection portions. With this structure, it is possible to improve stability when the accommodation space of the container body is exposed.

The connection portion can cover an entire outer surface of a contacting portion when the upper container body and the lower container body are assembled, the contacting portion being where a surface on which the connection portion connects to the upper container body is in contact with a surface on which the connection portion connects to the lower container body. With this structure, it is possible to increase airtightness of the accommodation space in the container.

The connection portion can have a thick portion that is formed to extend in an upper-lower direction when the container body and the lower container body are assembled, and, in the connection portion, the thick portion can be thicker than a portion other than the thick portion. With this structure, it is possible to improve the strength of the connection portion.

DETAILED DESCRIPTION

Hereinafter, the home tissue paper accommodation container 100 as an embodiment of the present invention is described in detail with reference to FIG. 1 to FIG. 16B. However, the scope of the invention is not limited to the illustrated examples.

Figure 1:
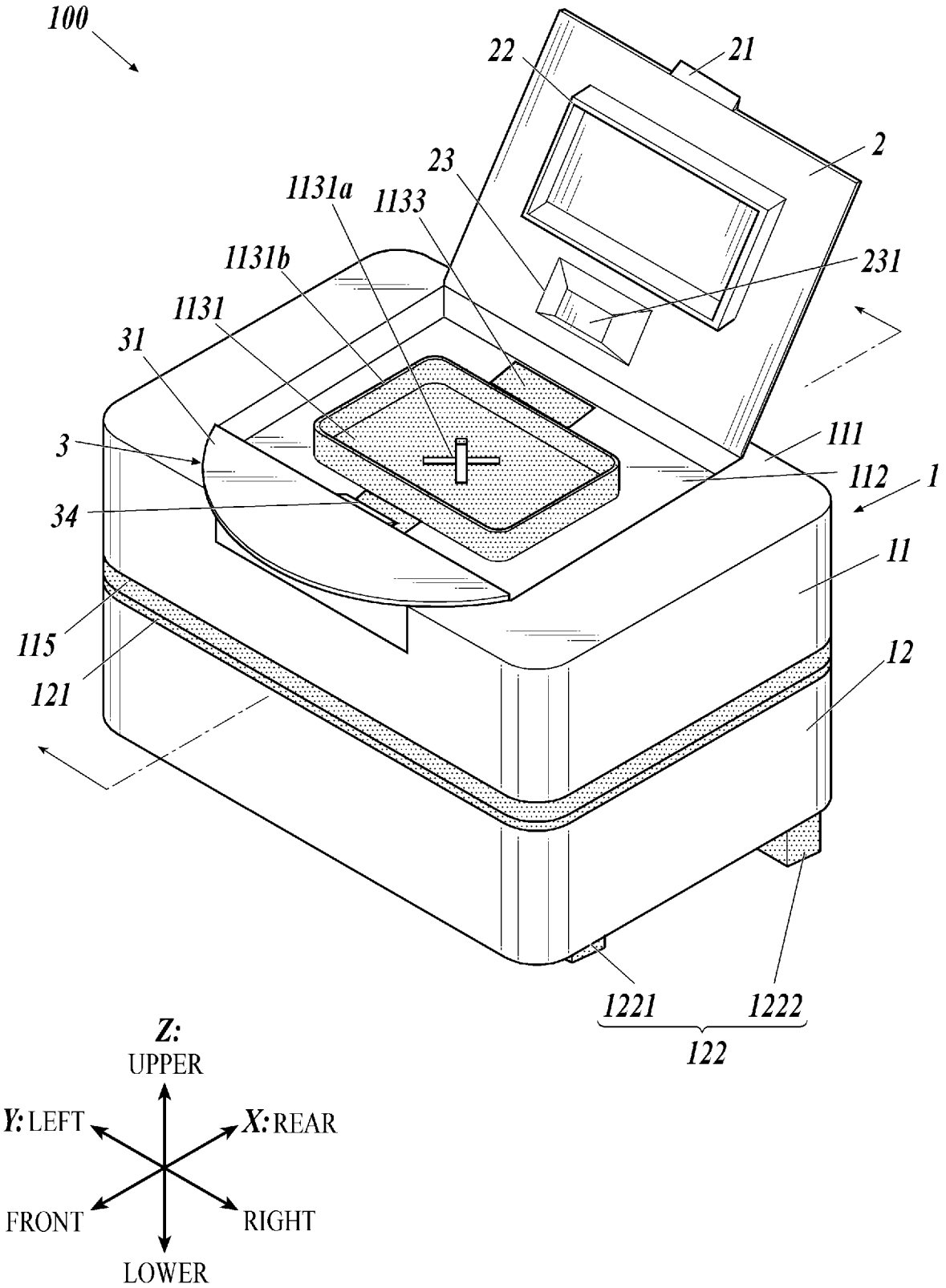
FIG. 1 is a perspective view of a home tissue paper accommodation container according to an embodiment viewed diagonally from the front. Shaded areas represent portions formed of an elastic material. This also applies to other drawings.

In the following description, an X-axis, Y-axis, Z-axis, front-rear direction, left-right direction, and upper-lower direction are defined as shown in FIG. 1. That is, the side of the home tissue paper accommodation container 100 on which the open/close lid 2 is provided and the side opposite thereto are referred to as "upper" and "lower", respectively. The side where a container body 1 and the open/close lid 2 are connected and the side opposite thereto are referred to as "rear" and "front", respectively. The right-hand side and the left-hand side when one is facing toward the rear are referred to as "right" and "left", respectively. The axis along the front-rear direction is referred to as the X axis, the axis along the left-right direction is referred to as the Y axis, and the axis along the upper-lower direction is referred to as the Z axis. As the upper container body 11 pivots with respect to the lower container body 12, the direction in which the upper container body 11 faces changes. However, in the following description, the directions are ones defined in a standard state in which the upper container body 11 and the lower container body 12 are assembled as shown in FIG. 1, such that the accommodation space S is closed.

[Configuration of Embodiment]

{Overall Configuration}

As shown in FIG. 1 to FIG. 5, the home tissue paper accommodation container 100 includes a container body 1 that has an outlet 1131*a* through which the inside home tissue paper is taken out, an open/close lid 2 that covers the outlet 1131*a* and is connected to the container body 1 so as to be freely opened and closed, and a button portion 3 that is provided on the container body 1 and is used in opening and closing the open/close lid 2. The container body 1 has an accommodation space S that is formed to accommodate the home tissue paper P inside.

The container body 1 and the open/close lid 2 can be integrally formed by injection molding (double molding).

{Home Tissue Paper}

The home tissue paper P is, for example, so-called pop-up type sheets in which small wet sheets, wet tissues, or the like are folded and stacked in alternating directions such that, when one wet sheet, wet tissue, or the like is pulled out, the next one is also pulled out. Another example of the home tissue paper P is a roll sheet that is a long wet sheet, wet tissue, or the like that is wound into a roll and has perforations at regular intervals in the length direction so as to be cut along the perforations and used.

{Container Body}

Figure 2:
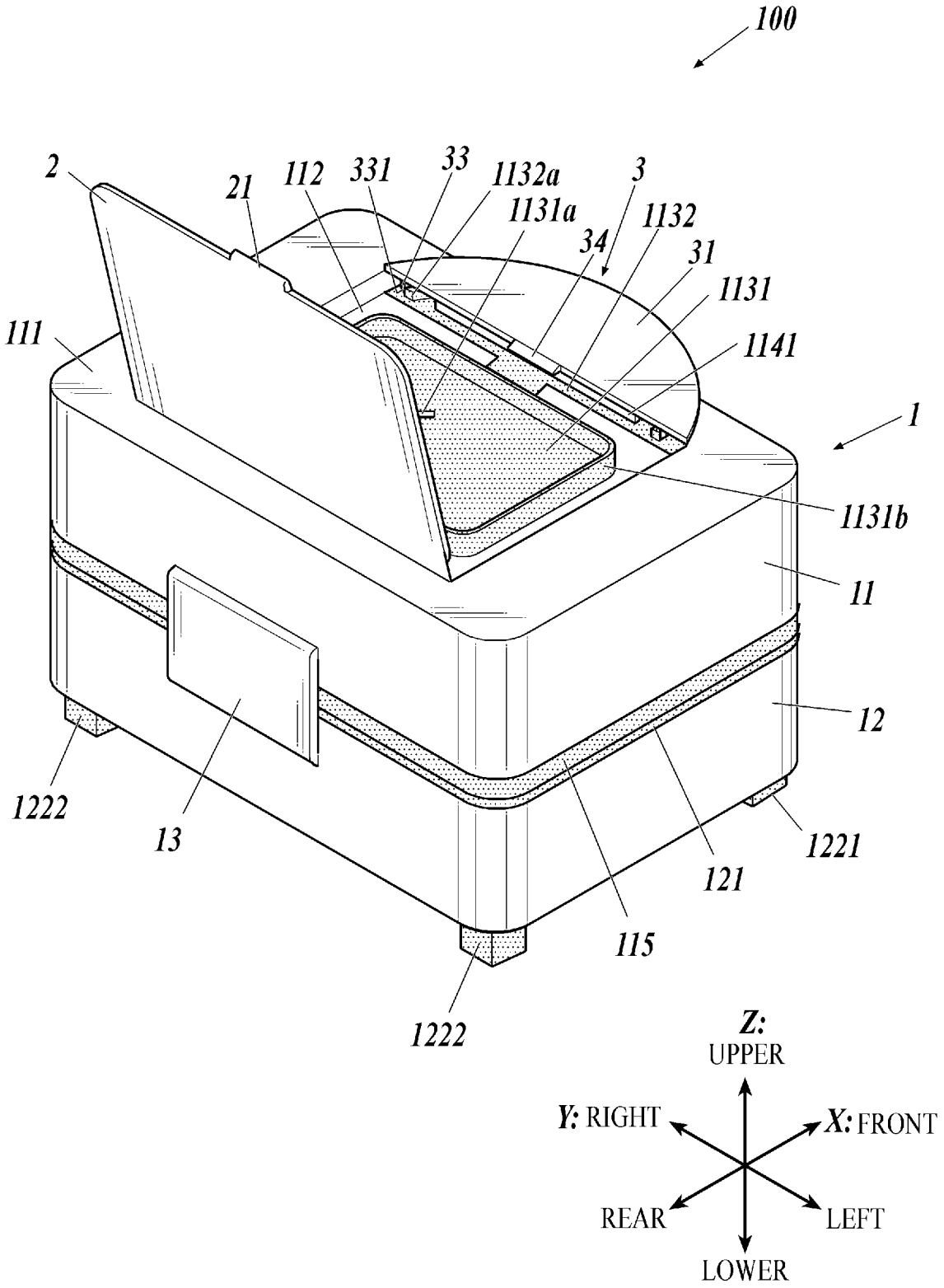
FIG. 2 is a perspective view of the home tissue paper accommodation container according to the embodiment viewed diagonally from the rear.

As shown in FIG. 1 and FIG. 2, the container body 1 as a whole is formed in a substantially rectangular parallelepiped shape that is longer in the Y direction than in the X and Z directions. The container body 1 is vertically divided into two parts almost in the middle in the Z direction, one being an upper container body 11 constituting the upper side of the container body 1 and the other being a lower container body 12 constituting the lower side of the container body 1. The upper container body 11 and the lower container body 12 are connected to each other by a connection portion 13 on the rear side of the container body 1.

The upper container body 11 and the lower container body 12 are integrally formed by a method such as injection molding (double molding).

When the upper container body 11 and the lower container body 12 are assembled as shown in FIG. 1 and FIG. 2 such that the inside accommodation space S is closed, the dimensions of the container body 1 as a whole are preferably 60 mm to 150 mm, more preferably 80 mm to 100 mm in the X direction, preferably 80 mm to 200 mm, more preferably 145 mm to 165 mm in the Y direction, and preferably 30 mm to 100 mm, more preferably 50 mm to 70 mm in the Z direction.

The thickness of each surface is preferably 0.5 mm to 3 mm, more preferably 1 mm to 2 mm.

With such dimensions and thickness, it is possible to achieve high molding efficiency and strength that does not cause any problems in actual use.

Figure 5:
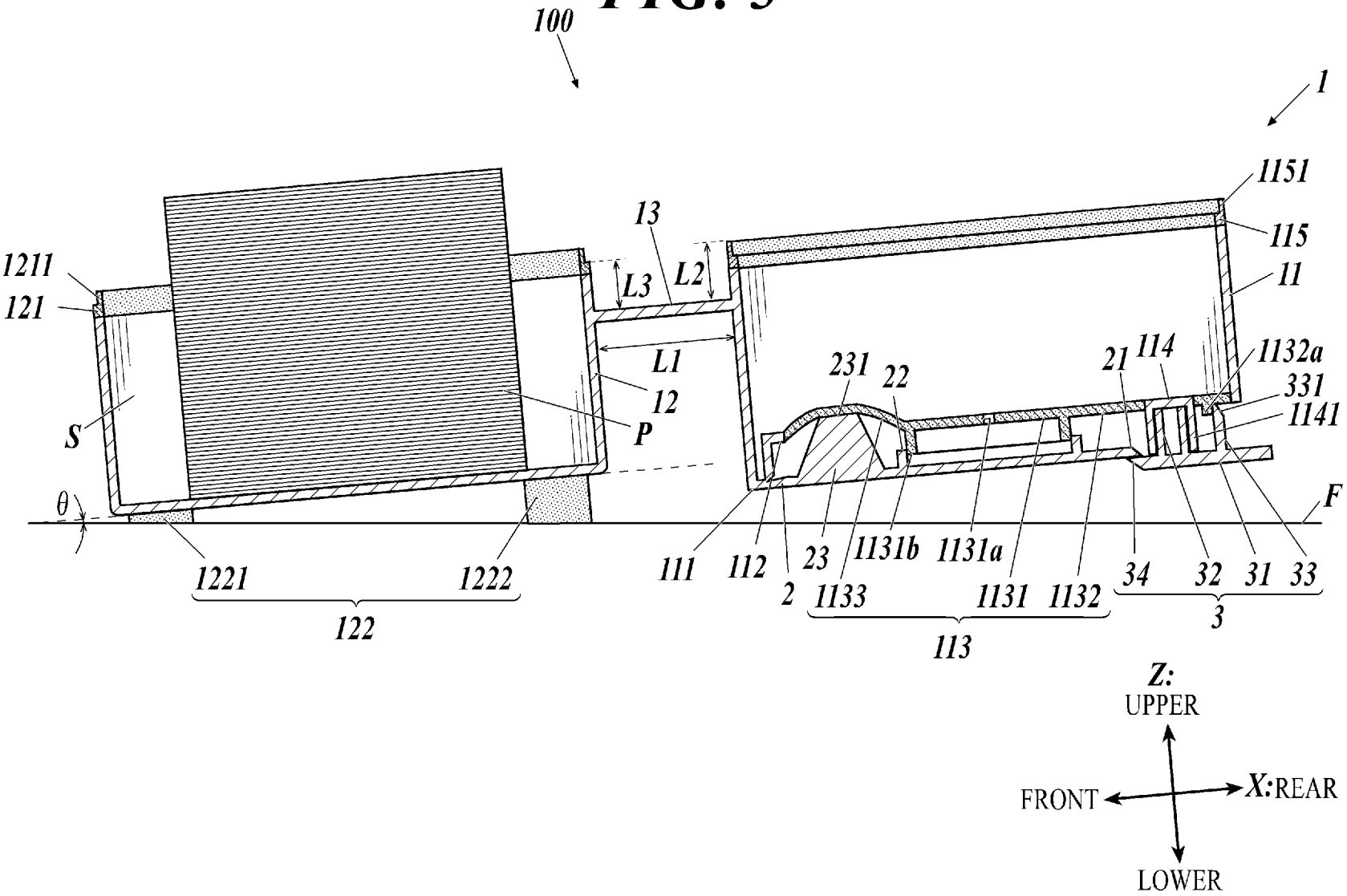
FIG. 5 is a sectional view of a portion corresponding to FIG. 3 when an open/close lid is in an open state.

As shown in FIG. 5, the container body 1 can expose the internal accommodation space S to the outside in the upper direction around a pivot point on the rear side of the container body 1. The upper container body 11 and the lower container body 12 are connected on the rear side. The upper container body 11 and the lower container body 12 are connected by the connection portion 13 that will be described later.

The container body 1 is divided into the upper container body 11 and the lower container body 12 almost in the middle in the Z direction in FIG. 1 to FIG. 5, but may be divided at a position above the middle in the Z direction. This reduces the possibility that an end seal portion(s) of the package is pinched when the container is closed, and thereby makes it easier to refill the home tissue paper P to be accommodated in the container body 1 while being covered with a predetermined package.

(Upper Container Body)

As shown in FIG. 1 to FIG. 6, the upper container body 11 is formed in a substantially rectangular parallelepiped shape having an opening on a lower side and a top surface portion 111 on the upper surface, and has a recessed portion 112 in a sunken recessed shape formed near the middle of the top surface portion 111.

In the recessed portion 112, there are formed an elastic portion 113 formed of an elastic material and a button attachment portion 114 to which the button portion 3 is attached.

Around the opening on the lower side, there is formed an upper sealing portion 115 that fits to a lower sealing portion 121 of the lower container body 12 described later.

(Recessed Portion)

As shown in FIG. 1 to FIG. 6, the recessed portion 112 is a portion that is formed near the middle of the upper surface of the upper container body 11 in a plan view and formed toward the lower direction to form a recessed shape. In FIG. 1 to FIG. 6, the recessed portion 112 has a substantially rectangular shape reaching the front edge of the upper container body 11 in a plan view, but may have any specific shape and is not limited to this.

The recessed portion 112 preferably has a depth of 5 mm to 20 mm as viewed from the top surface portion 111. The size of the recessed portion 112 in a plan view is not particularly limited as long as the elastic portion 113 can be formed inside, but is preferably 40 mm to 80 mm in the X direction (the short side direction of the top surface portion 111) and 40 mm to 120 mm in the Y direction (the long side direction of the top surface portion 111).

(Elastic Portion)

The elastic portion 113 is a flexible portion formed of a predetermined elastic material in the recessed portion 112 at the upper surface of the upper container body 11, and includes an outlet portion 1131, a button moving portion 1132, and an open/close lid biasing portion 1133.

The elastic material forming the elastic portion 113 is, for example, a material having elasticity such as silicon rubber or a thermoplastic elastomer of a styrene-butadiene type, polyester type, polyethylene type, urethane type, or the like, and preferably has a hardness of 20 to 90. The hardness is measured based on JIS K 6253 (type A durometer).

The hardness of the elastic material less than the above range is not desirable from the viewpoint that the elastic materials are too soft to be molded and result in poor molding efficiency, that the button moving portion 1132 does not bias the button portion 3 sufficiently, and that the open/close lid biasing portion 1133 does not bias the open/close lid 2 described later sufficiently.

The hardness of the elastic material larger than the above range is not desirable from the viewpoint that the button moving portion 1132 biases the button portion 3 too much and that the open/close lid biasing portion 1133 biases the open/close lid 2 described later too much. Furthermore, the outlet portion 1131 where an outlet 1131*a* for taking out the home tissue paper P described later is formed is so hard that the sheet receives too much resistance to be easily taken out one by one, and that one cannot easily put one's finger inside the container in pulling out the sheet.

(Outlet Portion)

As shown in FIG. 1 to FIG. 6, the outlet portion 1131 is a portion formed of an elastic material near the middle portion of the recessed portion 112 in a plan view, has the outlet 1131*a* for taking out the home tissue paper P in the middle, and has a body-side sealing loop 1131*b* in a loop-shaped projection protruding in the upper direction at its periphery.

The outlet portion 1131 is desirably formed as a film of an elastic material having a thickness of 0.5 mm to 2 mm in the Z direction, except where the body-side sealing loop 1131*b* of the elastic material is formed.

(Outlet)

The outlet 1131*a* is a hole that is formed in the middle of the outlet portion 1131 in a plan view and connects to the accommodation space S.

Figure 6:
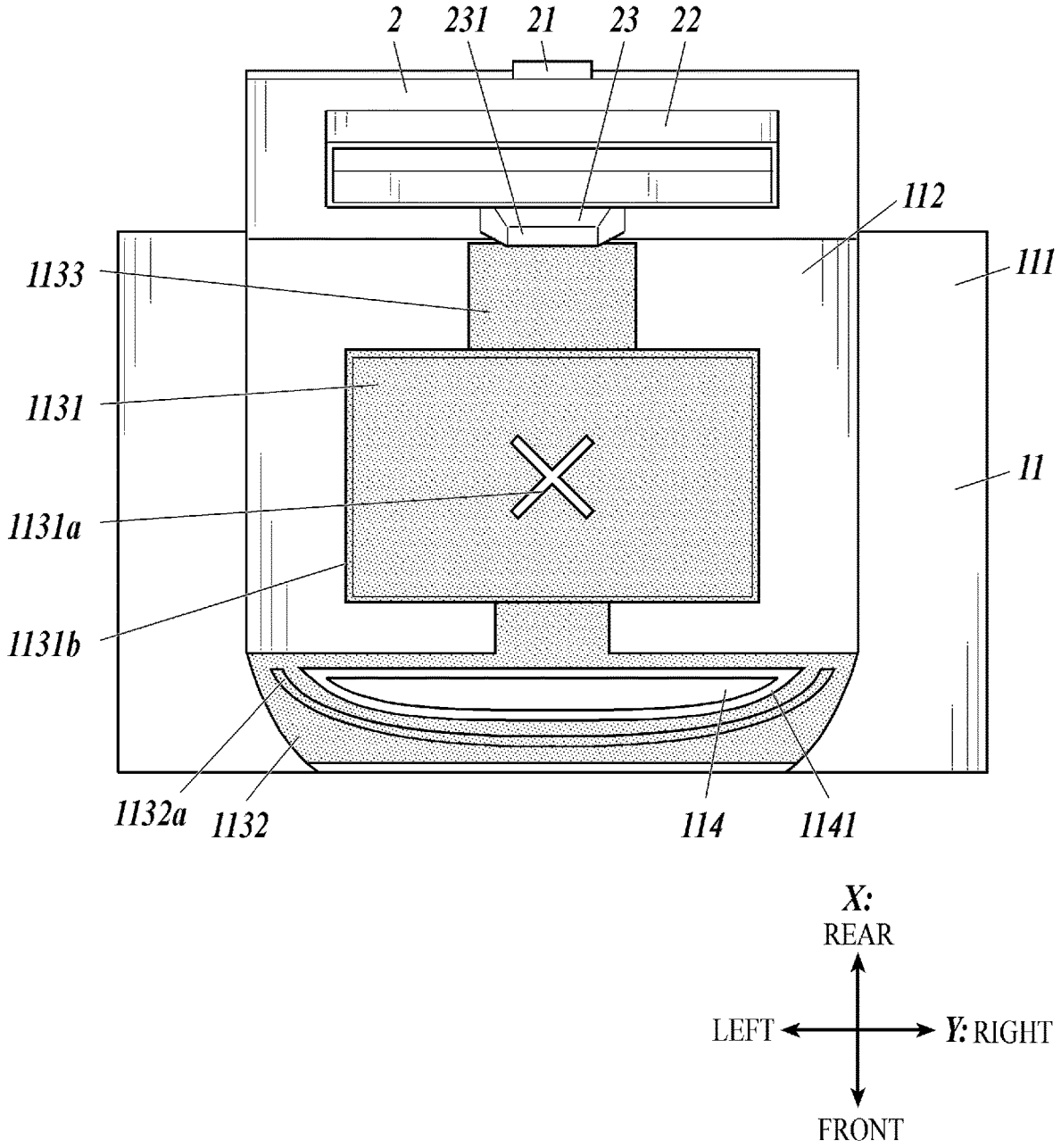
FIG. 6 is a plan view of the home tissue paper accommodation container according to the embodiment without a button portion.
Figure 7:
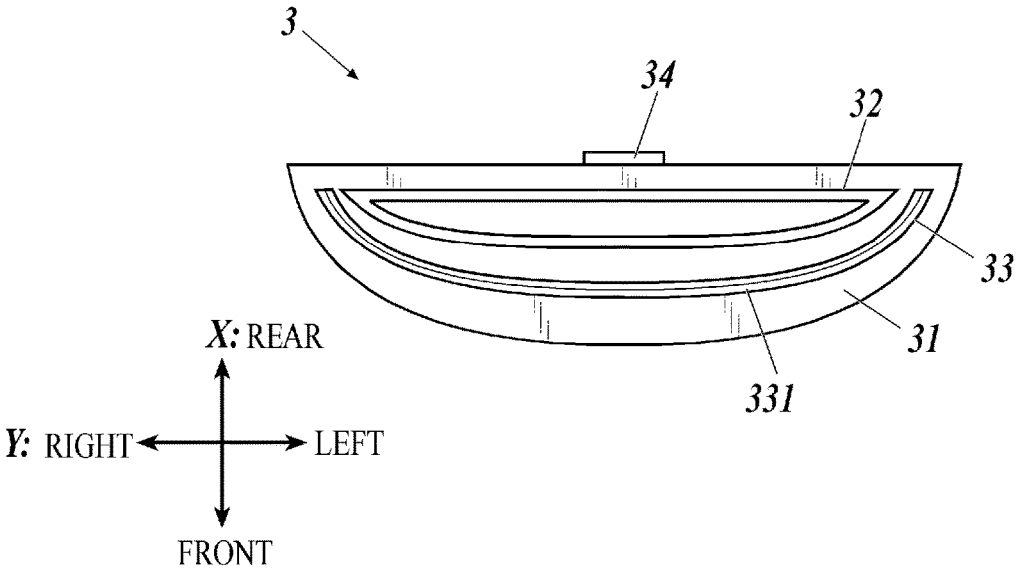
FIG. 7 is a bottom view of the button portion.

The outlet 1131*a* is formed by making two intersecting cuts in FIG. 1 and FIG. 6, but the present invention is not limited to this, and the number of cuts may be more than two. For example, three cuts may be made so as to connect respective vertices of a right triangle to the center of gravity of the right triangle.

The outlet portion 1131, formed of the elastic material in the periphery of the outlet 1131*a*, can apply appropriate resistance to the home tissue paper P. As a result, when a sheet of the home tissue paper P in the accommodation space S is pulled out, the next sheet of the home tissue paper P is held by the outlet 1131*a*. Furthermore, when the home tissue paper P is a roll sheet, the outlet 1131*a* can cut the home tissue paper P at its perforations provided for cutting.

(Body-Side Sealing Loop)

Figure 3:
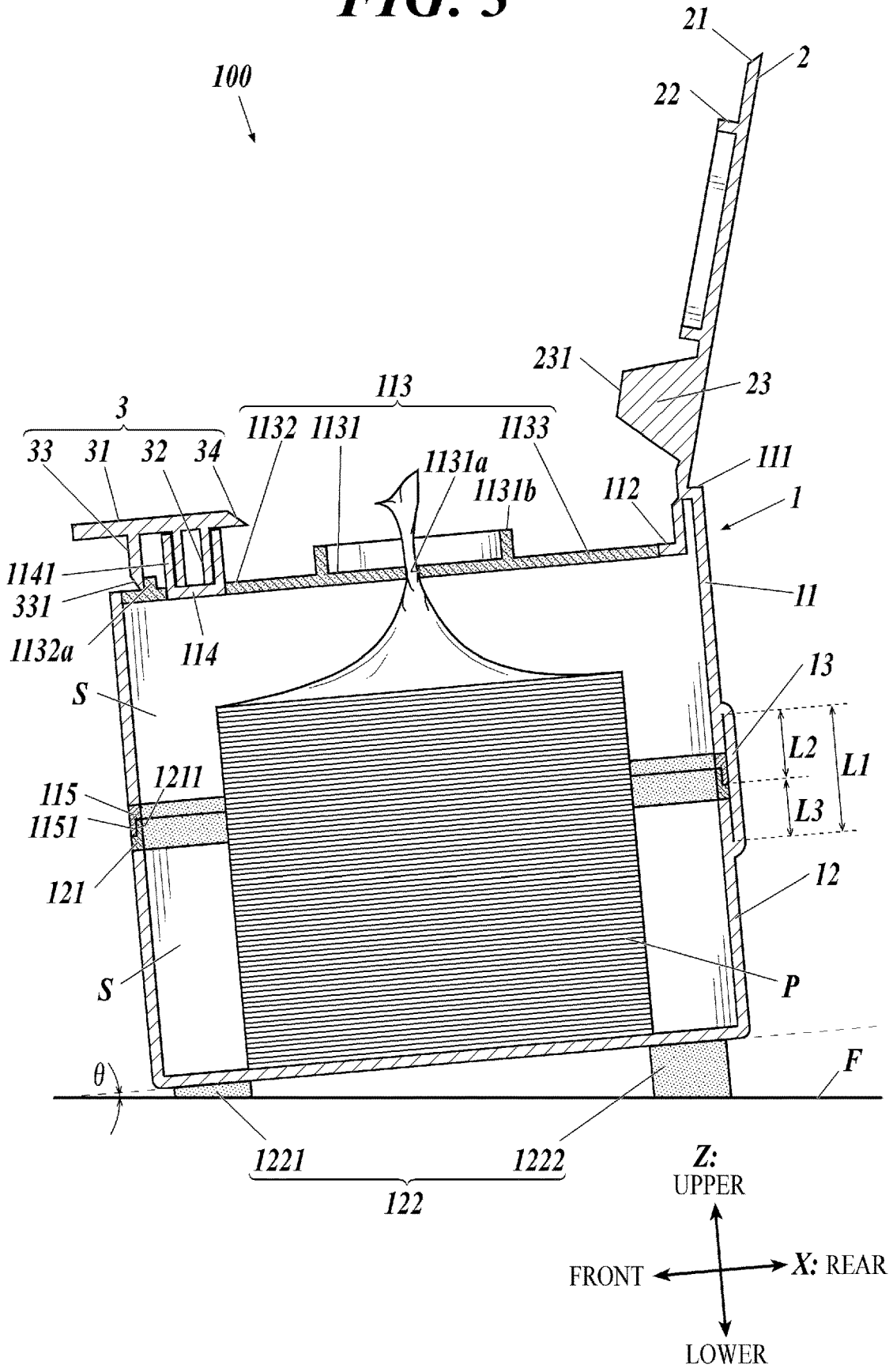
FIG. 3 is a sectional view of FIG. 1 cut through a middle portion in Y direction.
Figure 4:
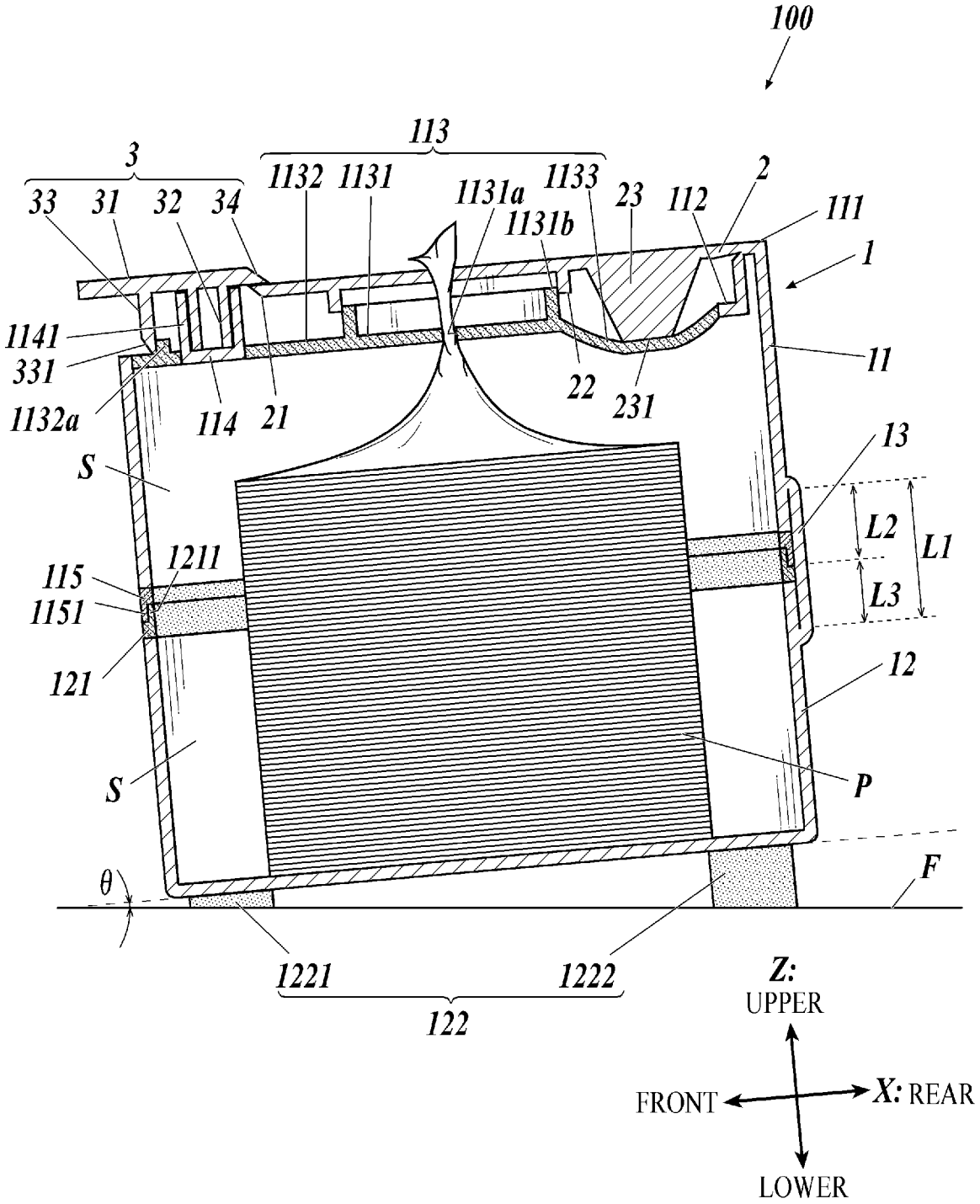
FIG. 4 is a sectional view of a portion corresponding to FIG. 3 when an open/close lid is in a closing state.

As shown in FIG. 1 to FIG. 6, the body-side sealing loop 1131*b* is a loop-shaped projection protruding in the upper direction and surrounding the outlet 1131*a*. As shown in FIG. 4 and FIG. 5, the outer peripheral surface of the body-side sealing loop 113 is formed so as to fit to the inner peripheral surface of the open/close-lid-side sealing loop 22 formed on the open/close lid 2 as described later.

(Button Moving Portion)

As shown in FIG. 2 to FIG. 6, the button moving portion 1132 is a flexible film-shaped portion formed of an elastic material in front of the outlet portion 1131 near the front edge of the recessed portion 112. The middle of the button moving portion 1132 in the Y direction is connected to the outlet portion 1131. The outlet portion 1131 and the button moving portion 1132 can be connected to each other at any position. For example, the left side of the front edge of the outlet portion 1131 may be connected to the left side of the rear edge of the button moving portion 1132, and the right side of the front edge of the outlet portion 1131 may be connected to the right side of the rear edge of the button moving portion 1132.

As shown in FIG. 6, the button moving portion 1132 is formed in a loop shape in a plan view so as to be provided with a button attachment portion 114 in the middle.

The button moving portion 1132 is desirably formed of an elastic material in a film shape having a thickness in the Z direction of 0.5 mm to 2 mm. The button moving portion 1132 may have any shape and size in a plan view as long as the button portion 3 described below can be attached thereto with the button attachment portion 114. However, as shown in FIG. 5, the button moving portion 1132 is desirably formed so as to cover the entire recessed portion 112 in the Y direction near the front edge of the recessed portion 112.

(Guide)

As shown in FIG. 2 to FIG. 6, the button moving portion 1132 has a guide 1132*a* on a front side of the button attachment portion 114. When the button portion 3 is attached to the button attachment portion 114, the guide 1132*a* is along the rear surface side of the front wall 33 of the button portion 3. The guide 1132*a* is a projection protruding from the upper surface of the button moving portion 1132 in the upper direction. The front surface side of the guide 1132*a* contacts the rear surface side of the front wall 33 of the button portion 3, so that the button portion 3 does not easily shift.

The guide 1132*a* is desirably formed so as to protrude from the upper surface of the button moving portion 1132 by 0.1 mm to 1 mm to the upper direction.

(Open/Close Lid Biasing Portion)

As shown in FIG. 1 to FIG. 3 and FIG. 6, the open/close lid biasing portion 1133 is a flexible film-shaped portion formed of an elastic material near the rear edge of the recessed portion 112. The open/close lid biasing portion 1133 is formed behind the outlet portion 1131 and connected to the middle of the outlet portion 1131 in the Y direction.

The open/close lid biasing portion 1133 is desirably formed of an elastic material in a film shape having a thickness in the Z direction of 0.5 mm to 2 mm. The open/close lid biasing portion 1133 may have any shape and size in a plan view as long as contacting an entire contact surface 231 on the lower surface of a biasing projection 23 formed on the open/close lid 2 described later, but is preferably 5 mm to 20 mm in the X direction (the short side direction of the top surface portion 111) and 10 mm to 100 mm in the Y direction (the long side direction of the top surface portion 111).

(Button Attachment Portion)

As shown in FIG. 3 to FIG. 6, the button attachment portion 114 is a portion surrounded by the button moving portion 1132 in a plan view, formed of a hard material described later, and has a body-side fitting portion 1141 in a loop shape protruding in an upper direction.

(Body-Side Fitting Portion)

As shown in FIG. 6, the body-side fitting portion 1141 has a loop shape having a curved part on the front side and a linear part on the rear side in a plan view and protrudes in the upper direction. The inner periphery of the body-side fitting portion 1141 is formed to be the same as or slightly larger than the outer periphery of the button-side fitting portion 32 formed on the button portion 3 described later. By inserting the button-side fitting portion 32 into the body-side fitting portion 1141 from above, the button portion 3 can be attached to the button attachment portion 114.

Alternatively, the outer periphery of the body-side fitting portion 1141 may be formed to be the same as or slightly smaller than the inner periphery of the button-side fitting portion 32 formed on the button portion 3 described later. In such cases, by inserting the body-side fitting portion 1141 into the button-side fitting portion 32 from the lower side, the button portion 3 can be attached to the button attachment portion 114.

As shown in FIG. 3 to FIG. 5, the height of the body-side fitting portion 1141 in the Z direction is desirably the same everywhere, and is desirably almost the same as the depth of the recessed portion 112 in the Z direction.

(Upper Sealing Portion)

As shown in FIG. 1 to FIG. 5, the upper sealing portion 115 is formed around the opening at the lower part of the upper container body 11. Only the outer periphery of the lower edge of the upper sealing portion 115 protrudes to form an upper protrusion 1151. The inner peripheral surface of the upper protrusion 1151 is formed so as to fit to the outer peripheral surface of the lower protrusion 1211 of the lower sealing portion 121 formed in the lower container body 12 as described later.

The sealing portion 115 is formed such that the upper protrusion 1151 has a dimension in the upper-lower direction of preferably 0.5 mm to 5 mm, more preferably 1 mm to 3 mm.

The upper sealing portion 115 is desirably formed of the above-described elastic material.

(Material of Upper Container Body)

As described above, the upper container body has the elastic portion 113 and the upper sealing portion 115 formed of the elastic material. The other portions of the upper container body are formed of a hard material that is harder than the elastic material. As the hard material, for example, polyethylene, polypropylene, and the like can be used. The hardness is measured with the same method as the one described regarding the elastic material.

It is desired that the portion formed of the elastic material and the portion formed of the hard material are integrally formed by injection molding (double molding).

(Lower Container Body)

As shown in FIG. 1 to FIG. 5, the lower container body 12 is formed in a substantially rectangular parallelepiped shape having an opening upper surface. Around the opening upper surface, there is formed a lower sealing portion 121 that fits to the upper sealing portion 115 of the upper container body 11. A placing portion 122 is formed on the lower surface.

(Lower Sealing Portion)

As shown in FIG. 1 to FIG. 5, the lower sealing portion 121 is formed around the opening on the upper part of the lower container body 12. Only the inner peripheral portion of the upper edge of the lower sealing portion 121 protrudes to form a lower protrusion 1211. The outer peripheral surface of the lower protrusion 1211 is formed so as to fit to the inner peripheral surface of the upper protrusion 1151 of the upper sealing portion 115 formed in the upper container body 11.

The lower sealing portion 121 is formed such that the lower protrusion 1211 has a dimension in the upper-lower direction of preferably 0.5 mm to 5 mm, more preferably 1 mm to 3 mm.

Alternatively, only the inner peripheral side of the upper protrusion 1151 of the upper sealing portion 115 and only the outer peripheral side of the lower protrusion 1211 of the lower sealing portion 121 may be each formed to protrude, such that the outer peripheral surface of the upper protrusion 1151 fits to the inner peripheral surface of the lower protrusion 1211.

Alternatively, the middle of the upper protrusion 1151 between the inner and outer peripheral sides and both of the inner and outer peripheral sides of the lower protrusion 1121 may be each formed to protrude, such that the upper protrusion 1151 fits to a recessed portion between the lower protrusions 1211. Conversely, both of the inner and outer peripheral sides of the upper protrusion 1151 and the middle of the lower protrusion 1211 between the inner and outer peripheral sides may be each formed to protrude, such that the lower protrusion 1211 fits to a recessed portion between the upper protrusions 1151.

(Placing Portion)

The placing portion 122 is a portion that comes into contact with the placing surface F such as a table when the home tissue paper accommodation container 100 is placed on the placing surface F, is formed of an elastic material, and protrudes downward from the lower surface of the lower container body 12.

As shown in FIG. 1 to FIG. 5 and FIG. 8, the placing portion 122 includes front placing portions 1221, 1221 and rear placing portions 1222, 1222 that are all formed of an elastic material. The front placing portions 1221, 1221 are formed near the front edge on the lower surface side of the lower container body 12, and the rear placing portions 1222, 1222 are formed near the rear edge on the lower surface side of the lower container body 12.

As shown in FIG. 1 to FIG. 5, the front placing portions 1221, 1221 and the rear placing portions 1222, 1222 are formed such that the rear placing portions 1222, 1222 are higher than the front placing portions 1221, 1221. As a result, when the home tissue paper accommodation container 100 is placed on a flat placing surface F as shown in FIG. to FIG. 5, the entire home tissue paper accommodation container 100 can be slightly inclined forward.

Specifically, the angle (θ in FIG. 3 to FIG. 5) formed between the lower surface of the lower container body 12 excluding the placing portion 122 and the placing surface F on which the home tissue paper accommodation container 100 is placed is preferably 1° to 5°, more preferably 1° to 3°.

The angle less than this range is not preferred because the effect of preventing the container from falling backward as described later is not sufficiently obtained. The angle exceeding this range is not preferred because the container is likely to fall forward.

(Front Placing Portion)

As shown in FIG. 1 to FIG. 5 and FIG. 8, the front placing portions 1221, 1221 are portions formed near the left and right ends near the front edge on the lower surface side of the lower container body 12, formed of an elastic material, and protruding downward.

As shown in FIG. 1 to FIG. 5, the front placing portions 1221, 1221 have respective flat lower surfaces that are each formed to be inclined in the front-rear direction with respect to the lower surface of the lower container body 12 and to be parallel to the left-right direction with respect to the lower surface of the lower container body 12.

Furthermore, the respective lower surfaces of the front placing portions 1221, 1221 are formed so as to be located on the same plane as each other and, at the same time, on the same plane as lower surfaces of the rear placing portions 1222, 1222 described later, as shown in FIG. 3 to FIG. 5.

Specifically, the front placing portions 1221, 1221 are preferably formed such that their height at the front edge is preferably 0.5 mm to 10 mm in the z direction, and their height at the rear edge is slightly higher than the height at the front edge.

Figure 8:
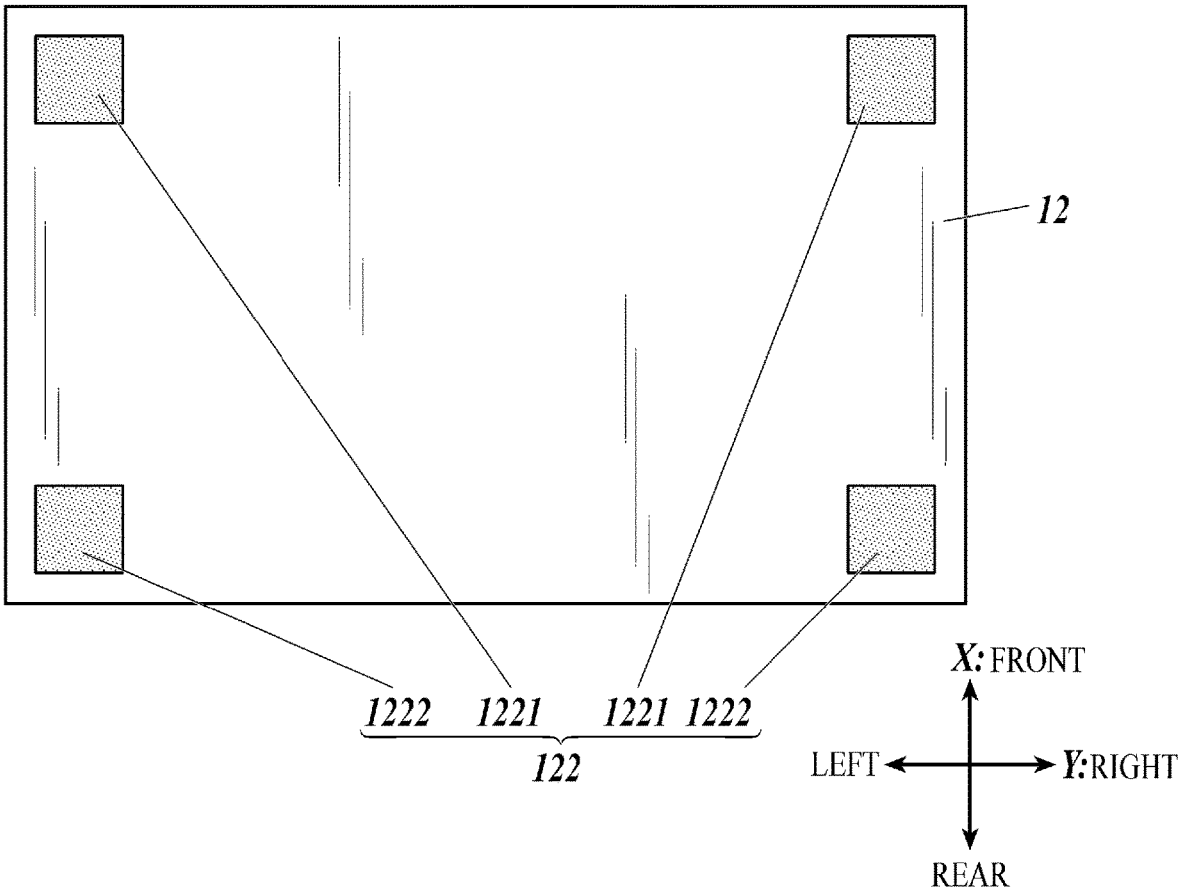
FIG. 8 is a bottom view of the home tissue paper accommodation container according to the embodiment.

The front placing portions 1221, 1221 are formed near the left front edge and near the right front edge of the lower surface of the lower container body 12. However, from the viewpoint of appearance of the home tissue paper accommodation container 100, they are preferably formed slightly inside, avoiding to be on, the front edge and the left and right edges of the lower surface of the lower container body 12, as shown in FIG. 8. Specifically, they are preferably formed 1 mm to 20 mm inside from the front edge and the left and right edges.

(Rear Placing Portion)

As shown in FIG. 1 to FIG. 5 and FIG. 8, the rear placing portions 1222, 1222 are portions formed near the left and right ends near the rear edge on the lower surface side of the lower container body 12, formed of an elastic material, and protruding downward.

As shown in FIG. 1 to FIG. 5, the rear placing portions 1222, 1222 have respective flat lower surfaces that are each formed to be inclined in the front-rear direction with respect to the lower surface of the lower container body 12 and to be parallel to the left-right direction with respect to the lower surface of the lower container body 12.

Furthermore, the respective lower surfaces of the rear placing portions 1222, 1222 are formed so as to be located on the same plane as each other and, at the same time, on the same plane as the lower surfaces of the front placing portions 1221, 1221, as shown in FIG. 3 to FIG. 5.

Specifically, the rear placing portions 1222, 1222 are preferably formed such that their height at the rear edge is 10 mm to 20 mm in the z direction, and their height at the front edge is slightly lower than the height at the rear edge. The height at the rear edge of the rear placing portions 1222, 1222 needs to be higher than the height at the front edge of the front placing portions 1221, 1221.

The rear placing portions 1222, 1222 are formed near the left rear edge and near the right rear edge of the lower surface of the lower container body 12. However, from the viewpoint of appearance of the home tissue paper accommodation container 100, they are preferably formed slightly inside, avoiding to be on, the rear edge and the left and right edges of the lower surface of the lower container body 12, as shown in FIG. 8. Specifically, they are preferably formed 1 mm to 20 mm inside from the rear edge and the left and right edges.

(Material of Lower Container Body)

The lower container body 12 has the lower sealing portion 121 and the placing portion 122 that are formed of an elastic material similar to the one used in the upper container body 11, and the other portions are formed of a hard material similar to the one used in the upper container body 11.

It is desired that they are integrally formed by injection molding (double molding).

(Connection Portion)

As shown in FIG. 2 to FIG. 5, the connection portion 13 is a portion that connects to the rear surface of the upper container body 11 and the rear surface of the lower container body 12, and is integrally formed with the upper container body 11 and the lower container body 12 by a method such as injection molding (double molding). Therefore, the connection portion 13 is formed of a hard material similar to the one used in the upper container body 11 and the lower container body 12, for example, polyethylene, polypropylene, and the like.

As shown in FIG. 2 to FIG. 5, in the state where the upper container body 11 and the lower container body 12 are assembled such that the accommodation space S is closed, the connection portion 13 does not connect the lower edge of the upper container body 11 and the upper edge of the lower container body 12 that contact with each other. Instead, the connection portion 13 is formed so as to connect to a portion that is at a predetermined distance from, not on, the lower edge of the upper container body 11, and to a portion that is at a predetermined distance from, not on, the upper edge of the lower container body 12.

The positions connected to the connection portion 13 only need be separated from, not on, the lower edge of the upper container body 11 and the lower container body 12, but are preferably determined as follows.

That is, preferably, the connection portion 13 is formed such that the length of the connection portion 13 (L1 in FIG. 3 to FIG. 5) is substantially the same as the total of the distance from the lower edge of the rear surface of the upper container body 11 to the upper edge of the connection portion 13 (L2 in FIG. 3 to FIG. 5) and the distance from the upper edge of the rear surface of the lower container body 11 excluding the lower protrusion 1211 to the lower edge of the connection portion 13 (L3 in FIG. 3 to FIG. 5).

From the viewpoint of making the connection portion 13 inconspicuous, most preferably, L1 is equal to L2+L3. However, considering accuracy in manufacturing and the purpose of closing the upper container body 11 easily, it is necessary to allow L1 to be slightly longer than L2+L3, which is included by the wording "substantially the same." Specifically, L1 is allowed to have a length longer than the length L2+L3 by 10% or less of the length L2+L3.

The specific values of L1, L2, and L3 are not particularly limited as long as the upper container body 11 and the lower container body 12 can be integrally formed. The length L1 is preferably 3 mm or more in order that the container body 1 can be easily manufactured with a sufficient space left between the upper the container body 11 and the lower container body 12 during the manufacturing. Furthermore, the length L1 is preferably 10 mm or less in order that the upper container body 11 and the lower container body 12 is prevented from separating from each other too much when the accommodation space S is opened.

The distance L2 and the distance L3 are preferably 2 mm or more and 5 mm or less, respectively.

Furthermore, from the viewpoint of connecting the upper container body 11 and the lower container body 12 with sufficient strength and making the connection portion 13 inconspicuous, the size of the connection portion 13 in the Y direction is preferably 50 mm to 120 mm.

{Open/Close Lid}

As shown in FIG. 1 to FIG. 6, the open/close lid 2 is a flat and substantially rectangular member that pivots freely, is connected to the rear side of the recessed portion 111 of the upper container body 11, has an open/close-lid-side latch portion 21 on the front side in a closing state, and has an open/close-lid-side sealing loop 22 and the biasing projection 23 on the lower surface side.

As shown in FIG. 1 to FIG. 6, the shape of the open/close lid 2 in a plan view in the closing state is formed to be substantially the same as the shape in a plan view of the recessed portion 112 of the upper container body 11 without the portion where the button portion 3 described later is formed. Therefore, the open/close lid 2 can fit to the recessed portion 112 and is on the same surface as the top surface portion 111 when closed.

(Open/Close-Lid-Side Latch Portion)

As shown in FIG. 1 to FIG. 6, the open/close-lid-side latch portion 21 is a hook-shaped portion protruding from the open/close lid 2 toward the front. The open/close-lid-side latch portion 21 engages with a button-side latch portion 34 formed at the button portion 3 described later, and the open/close lid is latched in the closing state. When a user pushes the button portion 3 described later, the open/close-lid-side latch portion 21 and the button-side latch portion 34 are disengaged, and the open/close lid 2 is opened because of the biasing force caused by the open/close lid biasing portion 1133 of the upper container body 11 and the biasing projection 23 formed on the open/close lid 2.

The shape of the open/close-lid-side latch portion 21 is not limited to have a hook shape as shown in FIG. 1 to FIG. 6, but may have any shape as long as the open/close-lid-side latch portion 21 engages with the button-side latch portion 34 to latch the open/close lid in the closing state, and as long as, when a user pushes the button portion 3, the open/close-lid-side latch portion 21 and the button-side latch portion 34 are disengaged.

(Open/Close-Lid-Side Sealing Loop)

As shown in FIG. 1 to FIG. 3 and FIG. 6, the open/close-lid-side sealing loop 22 is a loop-shaped projection protruding in the lower direction, and formed in the middle of the lower surface of the open/close lid 2 in the closing state. As shown in FIG. 4 and FIG. 5, the inner peripheral surface of the open/close-lid-side sealing loop 22 is formed so as to be fit to the outer peripheral surface of the body-side sealing loop 1131*b* formed on the upper container body 11.

(Biasing Projection)

As shown in FIG. 1 to FIG. 3 and FIG. 6, the biasing projection 23 is formed on the lower surface side of the open/close lid 2. The biasing projection 23 is formed in the middle in the Y direction and between the open/close lid-side sealing loop 22 and the connection portion where the open/close lid 2 and the upper container body 11 are connected. That is, the biasing projection 23 is a projection protruding in a lower direction when the open/close lid 2 is closed, and is formed at a position facing the open/close lid biasing portion 1133 formed in the upper container body 11 when the open/close lid 2 is closed.

As shown in FIG. 4 and FIG. 5, the protruding length of the formed biasing projection 23 is slightly longer than the distance between the lower surface of the open/close lid 2 and the open/close lid biasing portion 1133 when the open/close lid 2 is closed. The biasing projection 23 is formed so as to push the open/close lid biasing portion 1133 in the lower direction when the open/close lid 2 is closed.

Specifically, the biasing projection 23 is preferably formed longer than the distance between the lower surface of the open/close lid 2 and the open/close lid biasing portion 1133 by a length of 0.3 mm to 1 mm in the Z direction, and is preferably formed so as to push the open/close lid biasing portion 1133 in the lower direction by the length when the open/close lid 2 is closed.

(Contact Surface)

The biasing projection 23 has the contact surface 231 that has a flat lower end when the open/close lid 2 is closed and comes into contact with the open/close lid biasing portion 1133. The contact surface 231 is formed so that the entire contact surface 231 comes into contact with the open/close lid biasing portion 1133 when the open/close lid 2 is closed. The contact surface 231 is desirably formed so as to have an area of 0.015 $cm^2$ to 2 $cm^2$.

The biasing projection 23 illustrated in FIGS. 1 to 3 and FIG. 6 has a quadrangular pyramid shape having rectangular upper and lower bases. However, the shape of the biasing projection 23 is not limited to this, as long as the contact surface 231 is formed thereon. For example, it may be formed in a truncated cone shape or a rectangular parallelepiped shape.

(Material of Open/Close Lid)

As shown in FIG. 1 to FIG. 6, the entire open/close lid 2 is formed of a hard material similar to the one used in the container body 1.

(Button Portion)

As shown in FIG. 1 to FIG. 5 and FIG. 7, the button portion 3 is formed in the shape of a button having the button-side latch portion 34 that engages with the open/close-lid-side latch portion 21 of the open/close lid 2. The open/close lid 2 is thereby latched in the closing state. When a user pushes the button portion 3, the button-side latch portion 34 and the open/close-lid-side latch portion 21 are disengaged, and the open/close lid 2 is opened.

As described above, preferably, the entire home tissue paper accommodation container 100 is integrally formed by double molding except for the button portion 3. The button portion 3 is formed independently (as a separate member) using a hard material similar to the one used for the container body 1 and the like, and then is fixed on the upper side of the button moving portion 1132 using the button attachment portion 114.

As shown in FIG. 1 to FIG. 5 and FIG. 7, the button portion 3 is composed of an upper surface portion 31 as an upper surface, a button-side fitting portion 32 that protrudes from the upper surface portion 31 in the lower direction, a front wall 33, and the above-mentioned button-side latch portion 34.

(Upper Surface Portion)

As shown in FIG. 1 to FIG. 5 and FIG. 7, the upper surface portion 31 forms an upper surface of the button portion 3 and has a linear part on the rear side and a curved part on the front side in a plan view. Except for a vicinity of the front edge, the upper surface portion 31 is formed so as to have substantially the same shape as the shape in a plan view of the portion near the front edge of the recessed portion 112. The portion near the front edge of the upper surface portion 31 protrudes from the recessed portion 112 toward the front.

As shown in FIG. 3 to FIG. 5, the upper surface portion is formed so that the lower surface side thereof is located substantially at the same height as the top surface portion 111 of the upper container body 11 when the button portion 3 is not pushed from above.

The size of the upper surface portion 31 depends on the size of the portion of the recessed portion 112 that is not covered by the open/close lid 2, but is desirably 10 mm to 30 mm at the longest portion in the X direction and 30 mm to 100 mm at the longest portion in the Y direction.

(Button-Side Fitting Portion)

As shown in FIG. 3 to FIG. 5 and FIG. 7, the button-side fitting portion 32 has a loop shape having a curved part on the front side and a linear part on the rear side in a bottom view and protrudes in the lower direction. The outer periphery of the button-side fitting portion 32 is formed to be the same as or slightly smaller than the inner periphery of the body-side fitting portion 1141 described above. By inserting the button-side fitting portion 32 into the body-side fitting portion 1141 from above, the button portion 3 can be attached to the button attachment portion 114.

Alternatively, the inner periphery of the button-side fitting portion 32 may be formed to be the same as or slightly larger than the outer periphery of the body-side fitting portion 1141 described above. By inserting the body-side fitting portion 1141 into the button-side fitting portion 32 from the lower side, the button portion 3 can be attached to the button attachment portion 114.

The height of the button-side fitting portion 32 is substantially uniform everywhere, and is formed to be substantially the same as the body-side fitting portion 1141.

Furthermore, although not shown in the drawings, a connecting portion that connects the front surface side and the rear surface side of the button-side fitting portion 32 in the front-rear direction may be formed in order to improve the strength of the button-side fitting portion 32.

(Front Wall)

As shown in FIG. 2 to FIG. 5 and FIG. 7, the front wall 33 is in front of the button-side fitting portion 32, has a curved shape along the front surface side of the button-side fitting portion 32 in a bottom view, and protrudes in the lower direction. The entire front wall 33 is formed so as to have substantially the same height as the button-side fitting portion 32. The front wall 33 has an inclined surface 331 at its lower edge.

(Inclined Surface)

As shown in FIG. 2 to FIG. 5 and FIG. 7, the inclined surface 331 is formed near the lower edge of the front wall 33 and is a portion formed so that the front side thereof is inclined. The inclined surface 331 is formed in the vicinity of the entire lower edge of the front wall 33.

(Button-Side Latch Portion)

As shown in FIG. 1 to FIG. 5 and FIG. 7, the button-side latch portion 34 is a hook-shaped portion of the button portion 3 protruding to the rear direction. The button-side latch portion 34 engages with the open/close-lid-side latch portion 21 of the open/close lid 2, and the open/close lid is latched in the closing state. When a user pushes the button portion 3, the button-side latch portion 34 and the open/close-lid-side latch portion 21 are disengaged, and the open/close lid 2 is opened due to the biasing force by the open/close lid biasing portion 1133 of the upper container body 11 and the biasing projection 23 formed on the open/close lid 2.

As shown in FIG. 1, FIG. 2, and FIG. 6, the button-side latch portion 34 is formed so as to protrude from the middle in the Y direction of the upper edge of the rear part of the button portion 3 to the rear direction.

The shape of the button-side latch portion 34 is not limited to be a hook shape as shown in the drawings, but may be any shape as long as the button-side latch portion 34 engages with the open/close-lid-side latch portion 21 to latch the open/close lid 2 in the closing state, and as long as, when a user pushes the button portion 3, the button-side latch portion 34 and the open/close-lid-side latch portion 21 are disengaged.

For example, the button-side latch portion 34 may be a hole into which the open/close lid-side latch portion 21 is inserted.

[Effect from Embodiment]

Hereinafter, main effects from the present embodiment will be described (Overall Configuration)

According to the present embodiment, the container body 1 has the upper container body 11 and the lower container body 12, and their rear surfaces are connected by the connection portion 13. Therefore, while the container is left on a table or the like, the upper container body 11 can pivot around a pivot point on its rear edge portion. As a result, the accommodation space S is exposed so that the home tissue paper P is refilled.

Therefore, at the time of refill of the home tissue paper P, the home tissue paper accommodation container 100 does not need to be lifted but can be left on a table or the like during the refill.

Furthermore, the upper container body 11, the lower container body 12, and the connection portion 13 are integrally formed by a method such as injection molding. Therefore, manufacturing efficiency of home tissue paper accommodation container is also excellent.

(Connection Portion)

The home tissue paper accommodation container is used in a state where the upper container body 11 and the lower container body 12 are assembled such that the accommodation space S is closed. If the connection portion protrudes largely from the container body in such a state, various harmful effects can occur, such as deterioration of appearance of the home tissue paper accommodation container, obstruction of accommodation by the protruding portion, and user injuries caused by the protruding portion.

It may appear to be natural that the connection portion 13 connects the lower edge of the upper container body 11 and the upper edge of the lower container body 12 that contact with each other when the upper container body 11 and the lower container body 12 are assembled. However, because the connection portion 13 needs to have a certain length from the viewpoint of manufacturing the upper container body and the lower container body integrally as described above, thus manufactured connection portion 13 tends to protrude largely toward the rear surface of the container.

On the other hand, according to the present embodiment, the connection portion 13 is formed so as to connect to the portion that is at a predetermined distance from, not on, the lower edge of the upper container body 11 and to the portion that is at a predetermined distance from, not on, the upper edge of the lower container body 12. As a result, the protruding amount of the connection portion 13 toward the rear surface side of the container can be decreased, and the above harmful effects can be reduced.

Such effects can be most enhanced, as in the present embodiment, when the connection portion 13 is formed such that the length of the connection portion 13 (L1 in FIG. 3 to FIG. 5) is substantially the same as the total of the distance from the lower edge of the rear surface of the upper container body 11 to the upper edge of the connection portion 13 (L2 in FIG. 3 to FIG. 5) and the distance from the upper edge of the rear surface of the lower container body 11 excluding the lower protrusion 1211 to the lower edge of the connection portion 13 (L3 in FIG. 3 to FIG. 5). In a state where the upper container body 11 and the lower container body 12 are assembled such that the accommodation space S is closed, the connection portion 13 is substantially flat along the upper container body 11 and the lower container body 12 as shown in FIG. 3 and FIG. 4.

Furthermore, since the connection portion 13 has no excess play, it is easy to align the upper container body and the lower container body 12. It is also easy to assemble the upper container body 11 and the lower container body 12 and to close the accommodation space S.

Furthermore, according to the present embodiment, in the state where the upper container body 11 and the lower container body 12 are assembled such that the accommodation space S is closed, the connection portion 13 covers a part of the rear surface side of a contacting portion at which the upper container body 11 is in contact with the lower container body 12. Therefore, it is also possible to improve the airtightness of the accommodation space S.

(Placing Portion)

A container having an open/close lid that covers an outlet and is pivotally connected at the rear side of an upper surface of a container body easily falls backward in response to opening of the open/close lid, because the center of gravity of the entire container shifts backward.

According to the present embodiment, the rear placing portions 1222, 1222 are formed to be higher than the front placing portions 1221, 1221, which brings the center of gravity of the home tissue paper accommodation container 100 forward. Therefore, the container does not easily fall backward even if the center of gravity shifts to the rear in response to opening of the open/close lid 2.

Furthermore, since the front placing portions 1221, 1221 and the rear placing portions 1222, 1222 are formed to have respective lower surfaces that are all located on the same plane as each other, it is possible to improve stability when the home tissue paper accommodation container 100 is placed.

Furthermore, the front placing portions 1221, 1221 and the rear placing portions 1222, 1222 are each formed inside, avoiding to be on, the edges of the lower surface of the lower container body 12. As a result, the placing portion 122 is not easily seen when the home tissue paper accommodation container 100 is placed, and it is possible to reduce deterioration of the appearance even when the placing portion 122 is provided.

Furthermore, the placing portion 122 is formed of an elastic material, thereby having a non-slip effect. Therefore, the home tissue paper accommodation container 100 does not easily slip when placed.

Furthermore, when the button portion is provided on the front side of the home tissue paper accommodation container in order to open and close the open/close lid as in the present embodiment, the rear side of the home tissue paper accommodation container may be lifted up in response to pressing of the button. However, because the rear side of the container body is lifted higher than the front side in advance due to the placing portion 122 in the present embodiment, it is possible to suppress such lifting of the rear side of the container in response to pressing the button.

(Button Portion and the Like)

According to the home tissue paper accommodation container 100 according to the embodiment, the button portion 3 is attached to the button attachment portion 114 supported by the button moving portion 1132 made of an elastic material and is located on the button moving portion 1132. As a result, when a user pushes the upper surface portion 31 of the button portion 3 from above when the open/close lid 2 is closed, the button moving portion 1132 is distorted in the lower direction regardless of the pushed position, and the button portion 3 thereby moves in the lower direction.

Because the button portion 34 of the button portion 3 and the open/close-lid-side latch portion 21 of the open/close lid 2 are engaged, in response to the movement of the button portion 3 in the lower direction, the open/close lid 2 is also pushed in the lower direction. However, a biasing force that biases the open/close lid 2 in the upper direction and caused by the biasing projection 23 of the open/close lid 2 and the open/close lid biasing portion 1133 of the upper container body 11 becomes stronger as the open/close lid 2 moves in the lower direction.

Therefore, when the button portion 3 is pushed in to a certain extent, the open/close lid 2 moves in the lower direction in response to this, such that the biasing force on the open/close lid 2 in the upper direction becomes stronger. Because the open/close lid 2 and the button portion 3 are engaged only at the open/close-lid-side latch portion 21 and the button-side latch portion 34, when the biasing force on the open/close lid 2 becomes strong, they are disengaged and the open/close lid 2 is opened.

Therefore, according to the present embodiment, the open/close lid 2 can be easily opened in response to push of any part of the upper surface of the button portion 3.

Furthermore, because the button portion 3 has the button-side fitting portion 32 and the upper container body 11 has the button attachment portion 114 having the body-side fitting portion 1141, the button portion 3 can be easily fixed to the container body 1.

Furthermore, the button portion 3 can be attached more stably when having the front wall 33 than when supported only by the button-side fitting portion 32.

Also, because the inclined surface 331 is formed on the front surface near the lower edge of the front wall 33, the button portion 3 easily inclined forward in response to the strong biasing force in the upper direction, from the open/close lid 2 to the button portion 34 of the button portion 3. As a result, the open/close-lid-side latch portion 21 and the button-side latch portion 34 can be easily disengaged.

(Open/Close Lid Biasing Portion and Biasing Projection)

According to the home tissue paper accommodation container 100 according to the embodiment, the open/close lid 2 can be biased in the opening direction, as long as the upper container body 11 is provided with the open/close lid biasing portion 1133 and the open/close lid 2 is provided with the biasing projection 23.

It is not necessary to provide a further member in such a case, because the open/close lid biasing portion 1133 can be integrally formed with the upper container body 11, and the biasing projection 23 can be integrally formed with the open/close lid 2. Therefore, the biasing mechanism against the open/close lid 2 can be easily configured, and the production efficiency is improved as compared with the case where a separate leaf spring or the like is used.

Furthermore, when a spring-shaped biasing means formed of the elastic material, for example, and standing toward the upper direction is provided and connects to the open/close lid, such a spring-like portion is easily deteriorated by being repeatedly bent and stretched each time when the open/close lid is opened and closed. Then, the biasing force on the open/close lid tends to be weakened quickly. When the biasing force on the open/close lid is weakened to a certain extent, it is not possible to open it with a single touch.

On the other hand, according to the present embodiment, the open/close lid biasing portion 1133 in a film shape formed of the elastic material is pushed by the biasing projection 23 to generate the biasing force on the open/close lid 2. Therefore, the portion formed of the elastic material is deformed only slightly and is not easily deteriorated, so that the biasing force on the open/close lid is not easily weakened.

Furthermore, because the biasing projection 23 is provided with the contact surface 231, it is possible to prevent excessive pressure from being applied to the a contacting portion of the open/close lid biasing portion 1133 and the biasing projection 23, and to reduce the risk that the open/close lid biasing portion 1133 is damaged.

Furthermore, the open/close lid biasing portion 1133 and the biasing projection 23 are both formed near a pivot point on the rear side of the container around which the open/close lid 2 pivots. As a result, the open/close lid 2 is biased with a stronger force and can be easily opened.

Furthermore, according to the present embodiment, it is possible to form, with a method such as double molding, an elastic portion 113 continuously including the outlet portion 1131 used to take out the home tissue paper P, the button moving portion 1132 used to move the button portion 3, and the open/close lid biasing portion 1133 used to bias the open/close lid 2. From this point as well, the productivity of the home tissue paper accommodation container can be preferably improved.

(Further Configurations)

Furthermore, the body-side sealing loop **1131*b* is formed in the upper container body 11 with the elastic material and is configured to fit with the open/close lid-side sealing loop 22 when the open/close lid 2 is closed. As a result, the airtightness of the outlet 1131*a* and the accommodation space S inside the container body 1** can be improved.

When the container body 1 is closed, the upper sealing portion 115 formed of an elastic material in the upper container body 11 and the lower sealing portion 121 formed of an elastic material in the lower container body 12 fit to each other, and the airtightness of the container body 1 can be improved. This effect can be particularly enhanced when both the upper sealing portion 115 and the lower sealing portion 121 are made of an elastic material.

[Modified Embodiment]

Hereinafter, modified embodiments of the above embodiment will be described.

(Button Portion)

The button portion 3 does not have to be attached using the button attachment portion 114, as long as the upper container body 11 is provided with the button portion 3 that is movable up and down due to the button moving portion 1132. For example, the button moving portion 1132 may be provided over the entire lower surface of the button portion 3, and then the button portion 3 may be directly adhered and the like and attached to the button moving portion 1132.

(Open/Close Lid Biasing Portion)

Figure 9A:
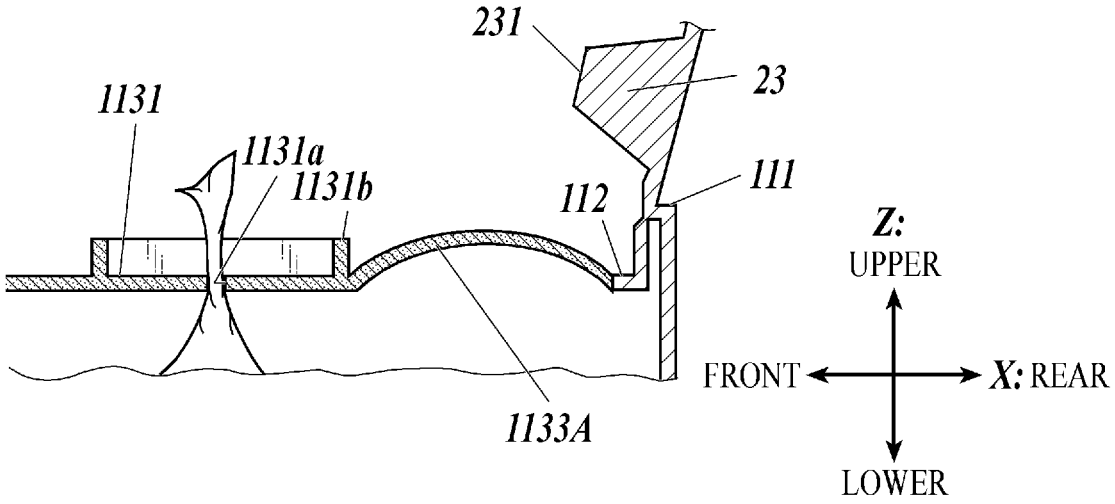
FIG. 9A is a partial cross-sectional view of a home tissue paper accommodation container according to a modified embodiment of an open/close lid biasing portion, at a portion corresponding to FIG. 3.

The specific shape of the open/close lid biasing portion is not limited to the above-mentioned planar film shape. For example, as shown in FIG. 9A, the open/close lid biasing portion 1133A may be formed so as to be convex in the upper direction when the lid is not particularly pushed. In this case, because the open/close lid 2 is deformed greatly when pushed by the biasing projection 23, such that the biasing force on the open/close lid 2 can be strengthened.

The open/close lid biasing portion may not be a single film, but may be formed by combining a plurality of films.

Figure 9B:
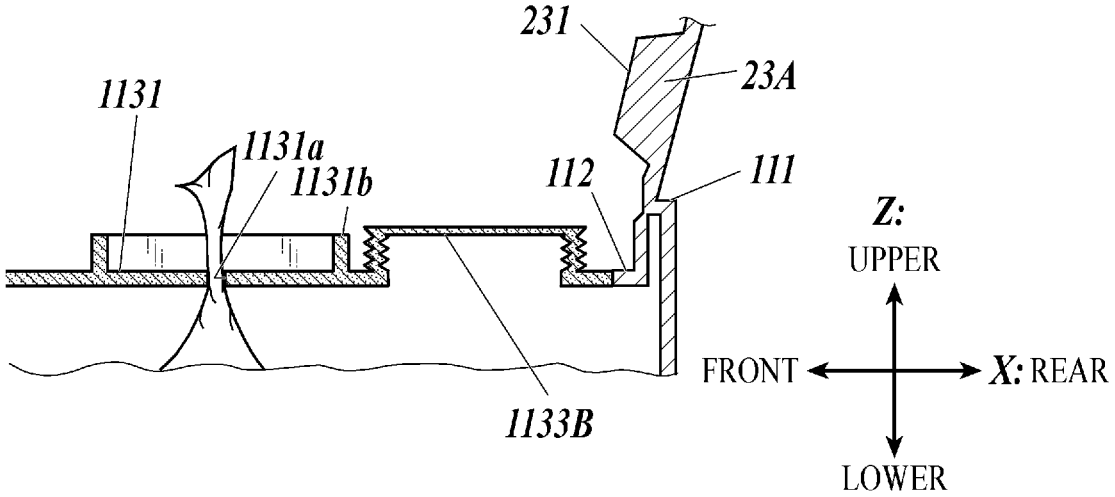
FIG. 9B is a partial cross-sectional view of the home tissue paper accommodation container according to the modified embodiment of the open/close lid biasing portion, at a portion corresponding to FIG. 3.

The open/close lid biasing portion is not limited to have a film shape, but may be a spring that is a bellows-shaped (accordion-folded) elastic material protruding in the upper direction, as the open/close lid biasing portion 1133B shown in FIG. 9B, for example. When the open/close lid 2 is closed, the bellows-shaped open/close lid biasing portion 1133B is pushed by the biasing projection 23A from above, and is folded to become smaller in the upper-lower direction. As a result, the biasing force on the open/close lid 2 is further increased.

In this case, the biasing projection 23A does not need to push the open/close lid biasing portion 1133B below the bottom surface of the recessed portion 112. Therefore, when the open/close lid 2 is closed, the biasing projection 23A may be less deep in the Z direction than the recessed portion 112.

Figure 10:
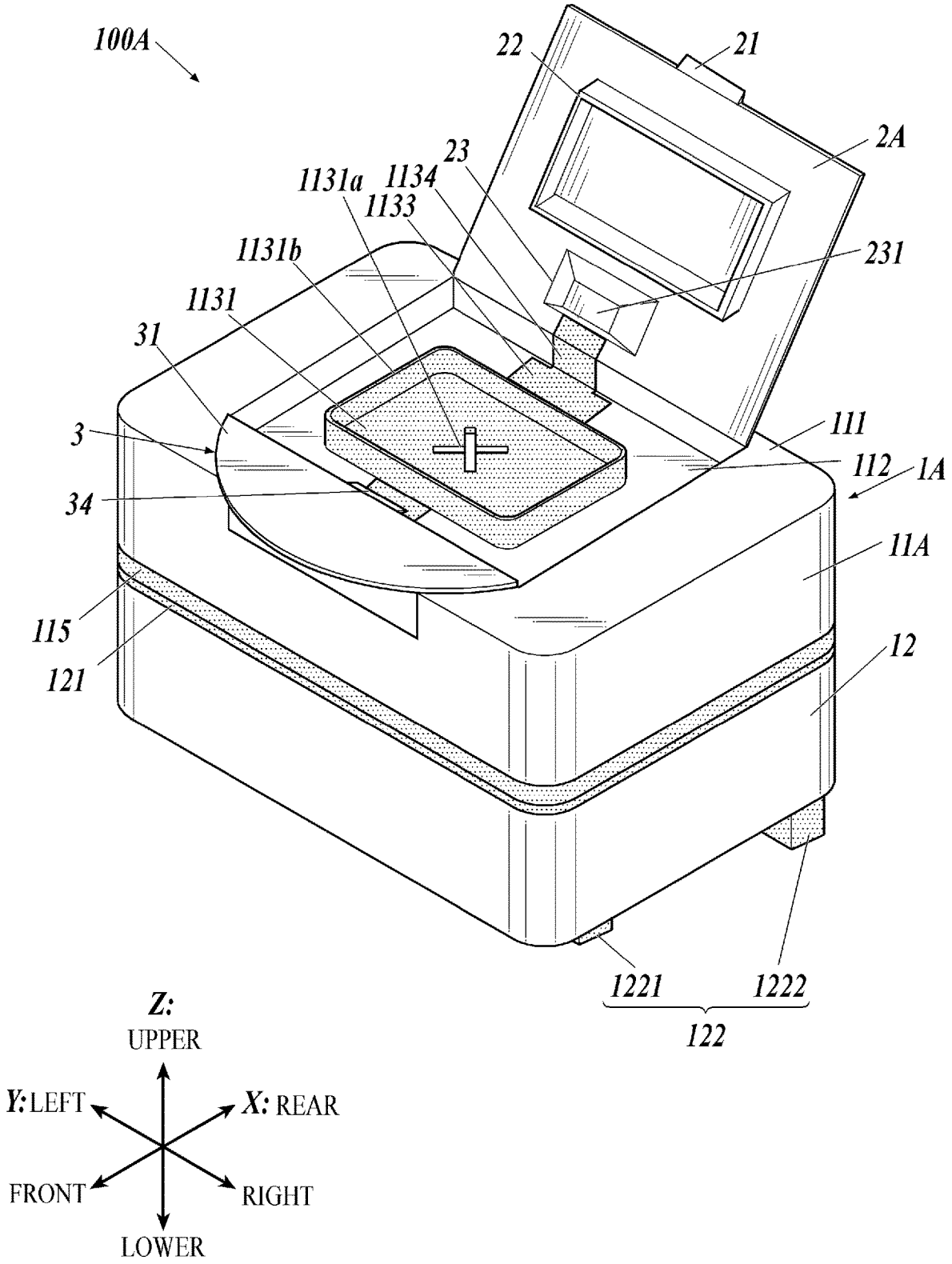
FIG. 10 is a perspective view of the home tissue paper accommodation container according to the modified embodiment of the open/close lid biasing portion viewed diagonally from the front.

Furthermore, as shown in FIG. 10, there may be provided a second open/close lid biasing portion 1134 formed of an elastic material extending from the rear side of the open/close lid biasing portion 1133 of the upper container body 11 to the open/close lid 2A.

The second open/close lid biasing portion 1134 is formed to be stretched when no force is applied thereto as shown in FIG. 10. When the open/close lid 2A is closed and the open/close lid biasing portion 1134 is folded, a force to return to the state shown in FIG. 10 is generated. This makes it possible to bias the open/close lid 2A with respect to the upper container body 11A, so that the open/close lid 2A pivots rearward on the rear connecting portion as a pivot shaft that connects the open/close lid 2A and the upper container body 11A.

Because of the second open/close lid biasing portion 1134 provided in this way, the open/close lid 2A can be biased not only by the above-mentioned open/close lid biasing portion 1133 and the biasing projection 23 but also by the second open/close lid biasing portion 1134. Therefore, it is possible to further strengthen the biasing force on the open/close lid 2 in the opening direction.

(Connection Portion)

In the above description, only one connection portion is formed near the middle portion in the left-right direction of the container body 1, but one connection portion 13 is not limited to this configuration.

Figure 11:
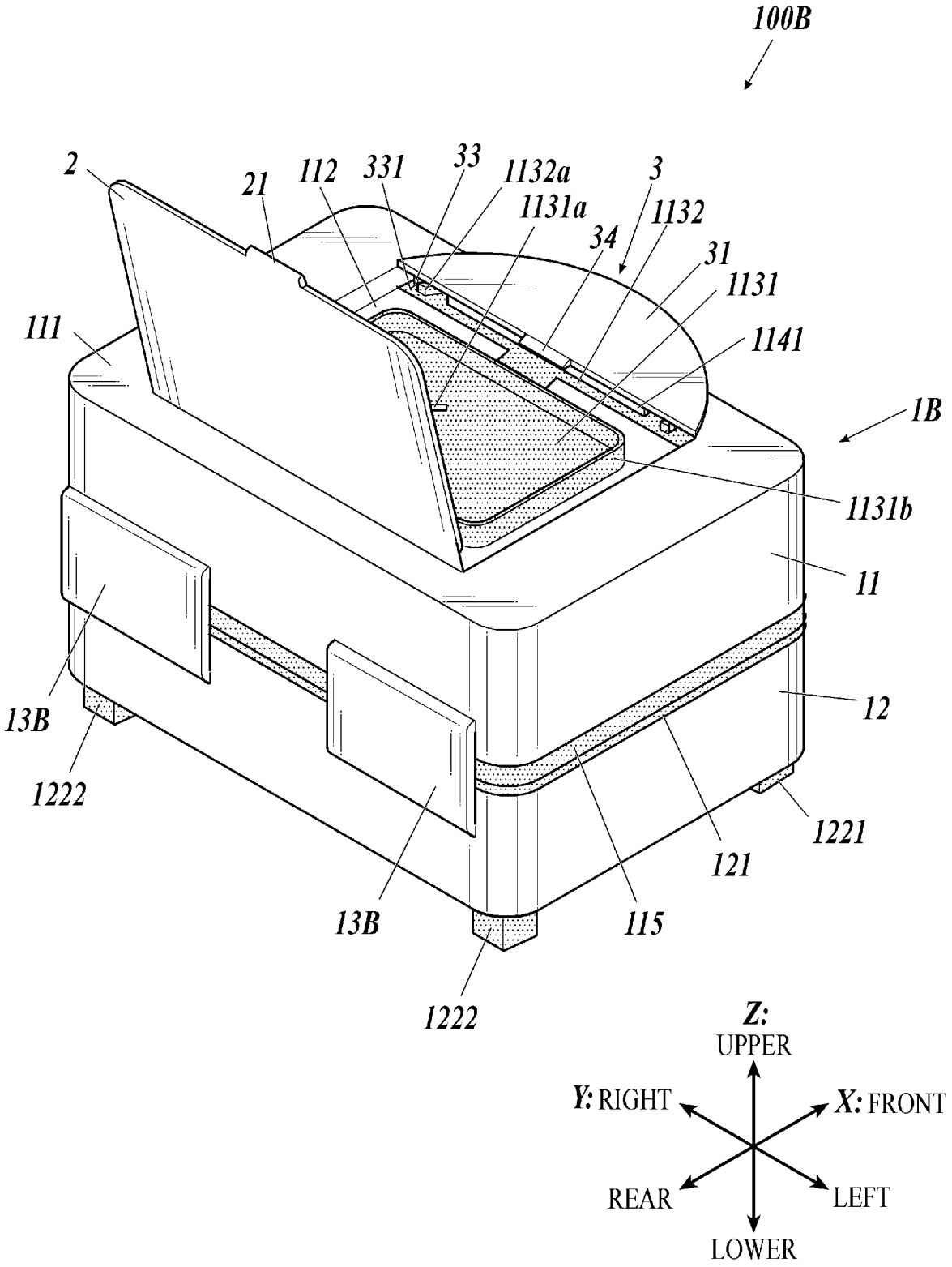
FIG. 11 is a perspective view of a home tissue paper accommodation container according to a modified embodiment of a connection portion viewed diagonally from the rear.

For example, as shown in FIG. 11, a container body 1B has connection portions 13B, 13B formed on the left and right. In this case, because the connection portion is not easily twisted when the container body 1B is opened, it is possible to improve the stability. This also makes it easier to close the container body 1B again.

Figure 12:
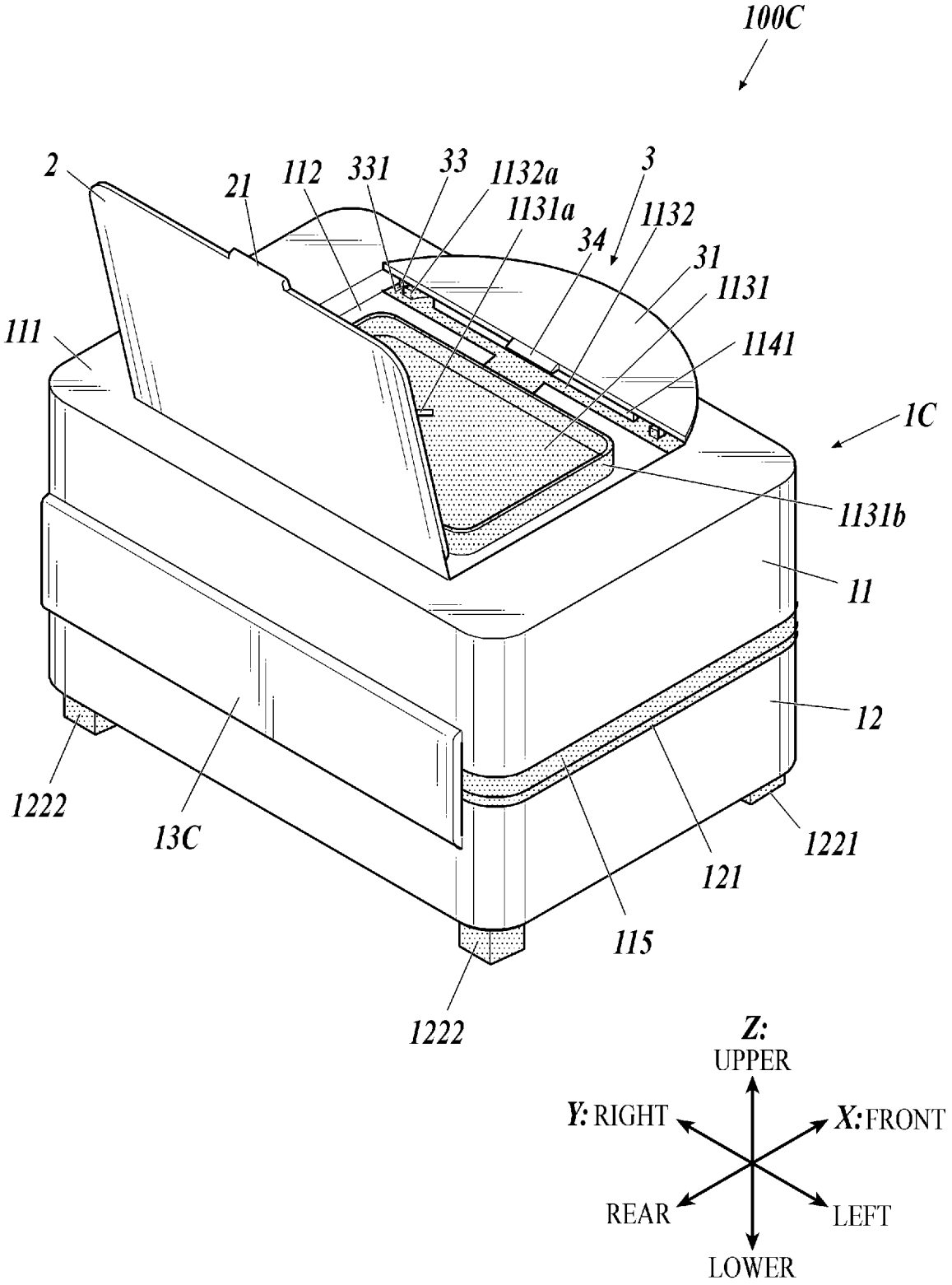
FIG. 12 is a perspective view of the home tissue paper accommodation container according to the modified embodiment of the connection portion viewed diagonally from the rear.

Alternatively, as shown in FIG. 12, a container body 1C has connection portion 13C that covers the entire surface of the rear surface of the container body 1C. According to this container body 1C, the rear surface side of a contacting portion where the upper container body 11 and the lower container body 12 contact with each other is entirely covered when the accommodation space S is closed. Therefore, it is possible to further increase airtightness of the accommodation space S.

Furthermore, the connection portion 13 is preferably formed as thin as possible in order to be inconspicuous and in order to be manufactured at a lower cost due to less amount of resin material used.

However, when this is formed to be too thin, there occurs a problem in terms of strength.

Figure 13:
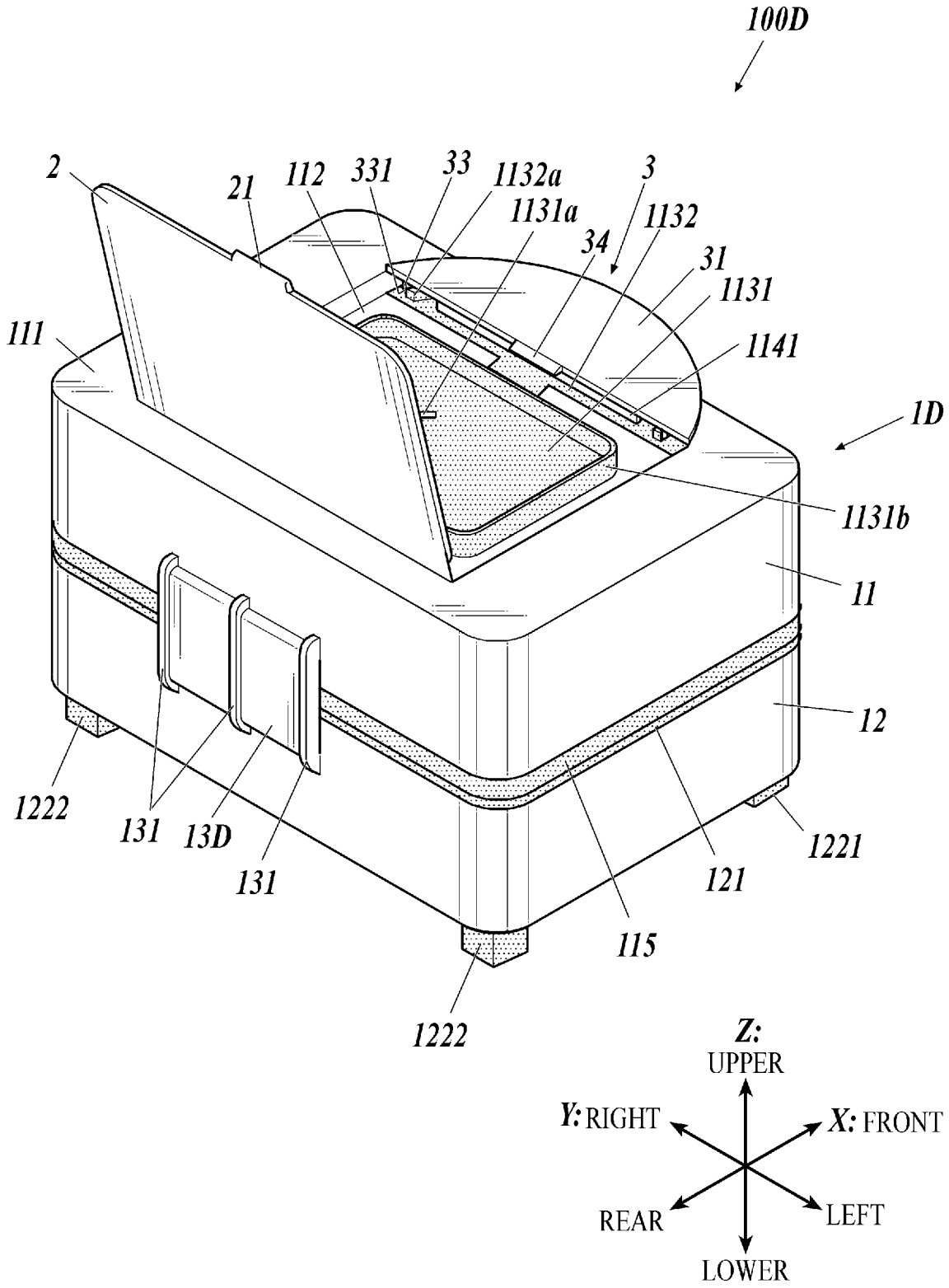
FIG. 13 is a perspective view of the home tissue paper accommodation container according to the modified embodiment of the connection portion viewed diagonally from the rear.

Therefore, as shown in FIG. 13, there may be provided a connection portion 13D that is thin as a whole and has a thick portion(s) 131 in a straight line extending in the upper-lower direction. As a result, the connection portion made to be thin has improved strength as well.

The number and positions of the thick portions 131 are not limited to those shown in FIG. 13. The connection portion may be provided with only one thick portion at the middle portion in the left-right direction, only two thick portions at both left and right edges, or more than three thick portions.

(Placing Portion)

In the above description, the placing portion is composed of the front placing portions 1221, 1221 and the rear placing portions 1222, 1222 that are formed near the four corners on the lower surface side of the lower container body 12, but is not limited to this configuration.

Figure 14A:
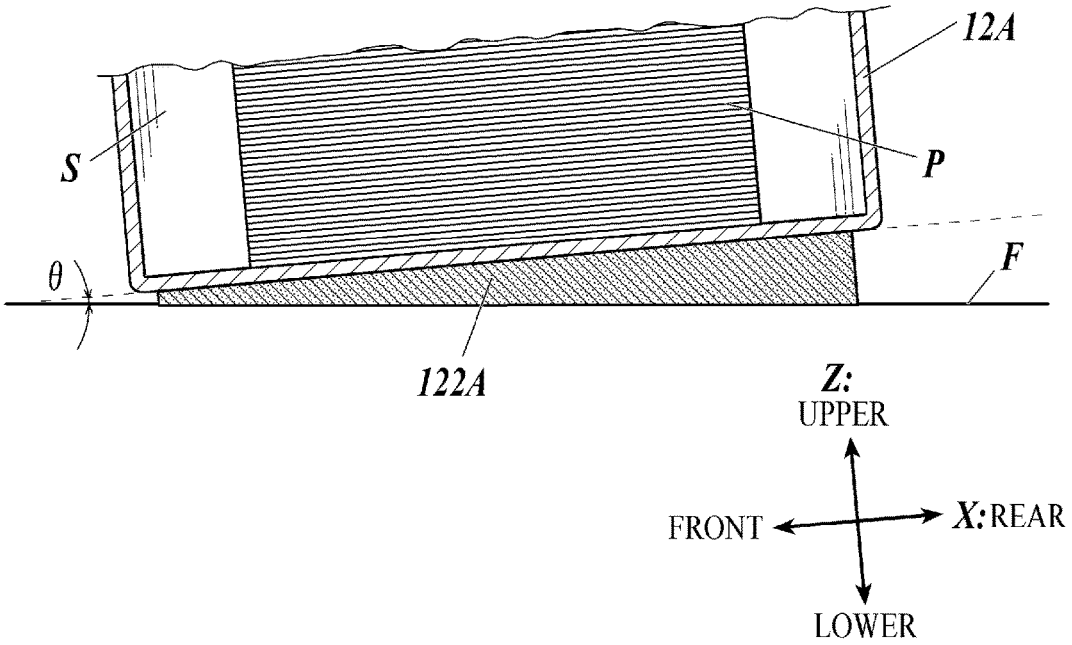
FIG. 14A is a sectional view of a home tissue paper accommodation container according to a modified embodiment of a placing portion, at a portion corresponding to FIG. 3 when an open/close lid is in a closing state. The upper part of the home tissue paper accommodation container is omitted in the drawing.
Figure 14B:
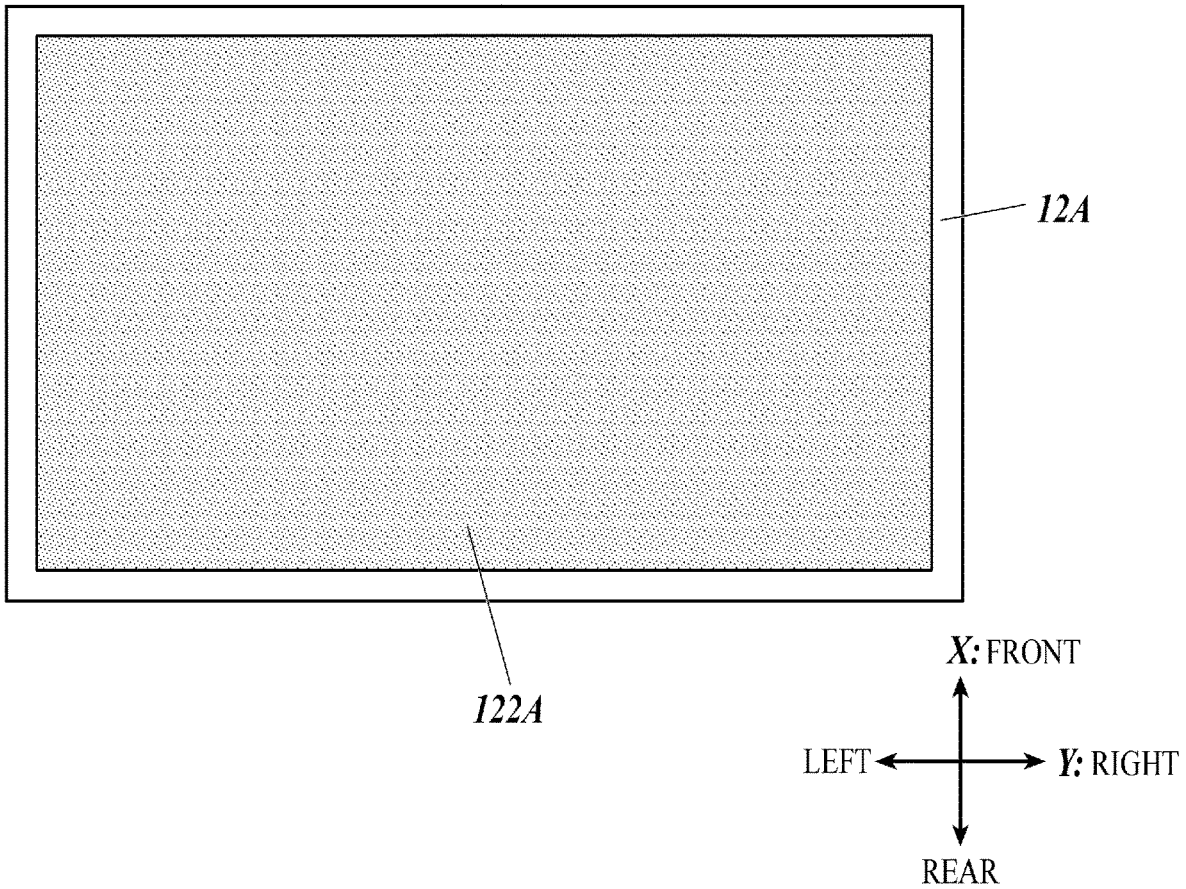
FIG. 14B is a bottom view of the home tissue paper accommodation container according to the modified embodiment of the placing portion.

For example, as shown in FIG. 14A and FIG. 14B, there may be formed a placing portion 122A that covers the entire lower surface of the lower container body 12A except near the edges.

In this case, the contact area of the placing portion 122A with the placing surface F is large. Therefore, the home tissue paper accommodation container can be placed on the placing surface F, stably and less slippery. Such an effect is particularly remarkable when the placing portion 122A is formed of an elastic material, but can be exhibited to a certain extent even when the placing portion 122A is not formed of an elastic material because of the large contact area with the placing surface F in either case.

Also in this case, as shown in FIG. 14A, the placing portion 122A is formed to be a flat lower surface inclined in the front-rear direction and parallel to the left-right direction with respect to the lower surface of the lower container body 12A.

The placing portion 122A is formed such that its height at the front edge is preferably 0.5 mm to 10 mm in the z direction, and its height at the rear edge is 10 mm to 20 mm in the z direction. The height of the placing portion 122A at the rear edge needs to be higher than the height of the placing portion 122A at the front edge.

The angle (θ in FIG. 14A) formed between the lower surface of the lower container body 12A excluding the placing portion 122A and the placing surface F on which the home tissue paper accommodation container is placed is preferably 1° to 5°, more preferably 1° to 3°.

Figure 15A:
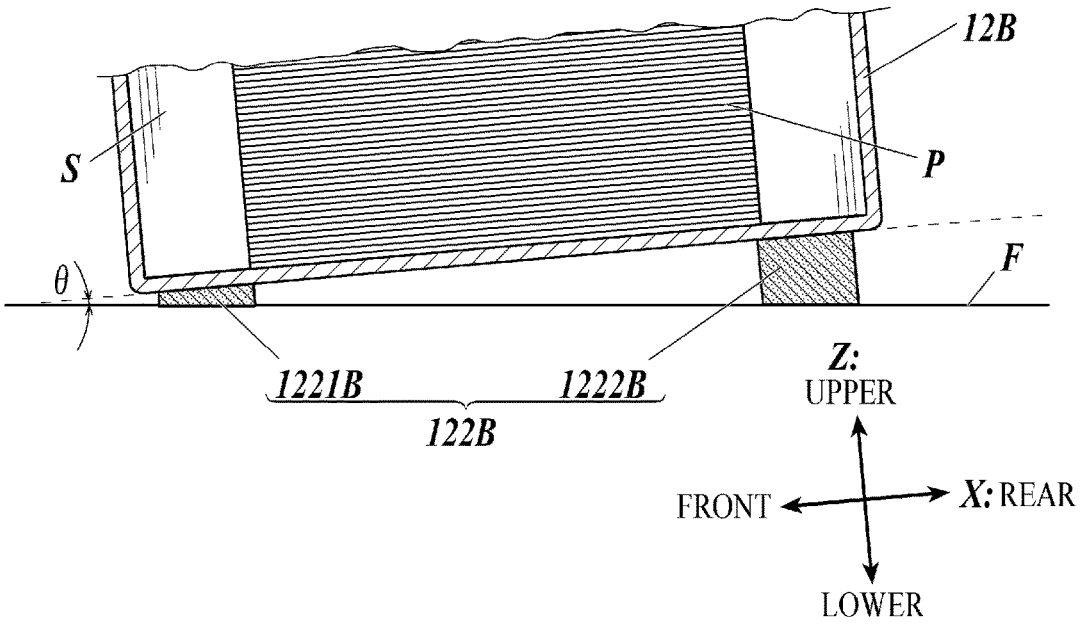
FIG. 15A is a sectional view of a home tissue paper accommodation container according to a modified embodiment of a placing portion, at a portion corresponding to FIG. 3 when an open/close lid is in a closing state. The upper part of the home tissue paper accommodation container is omitted in the drawing.
Figure 15B:
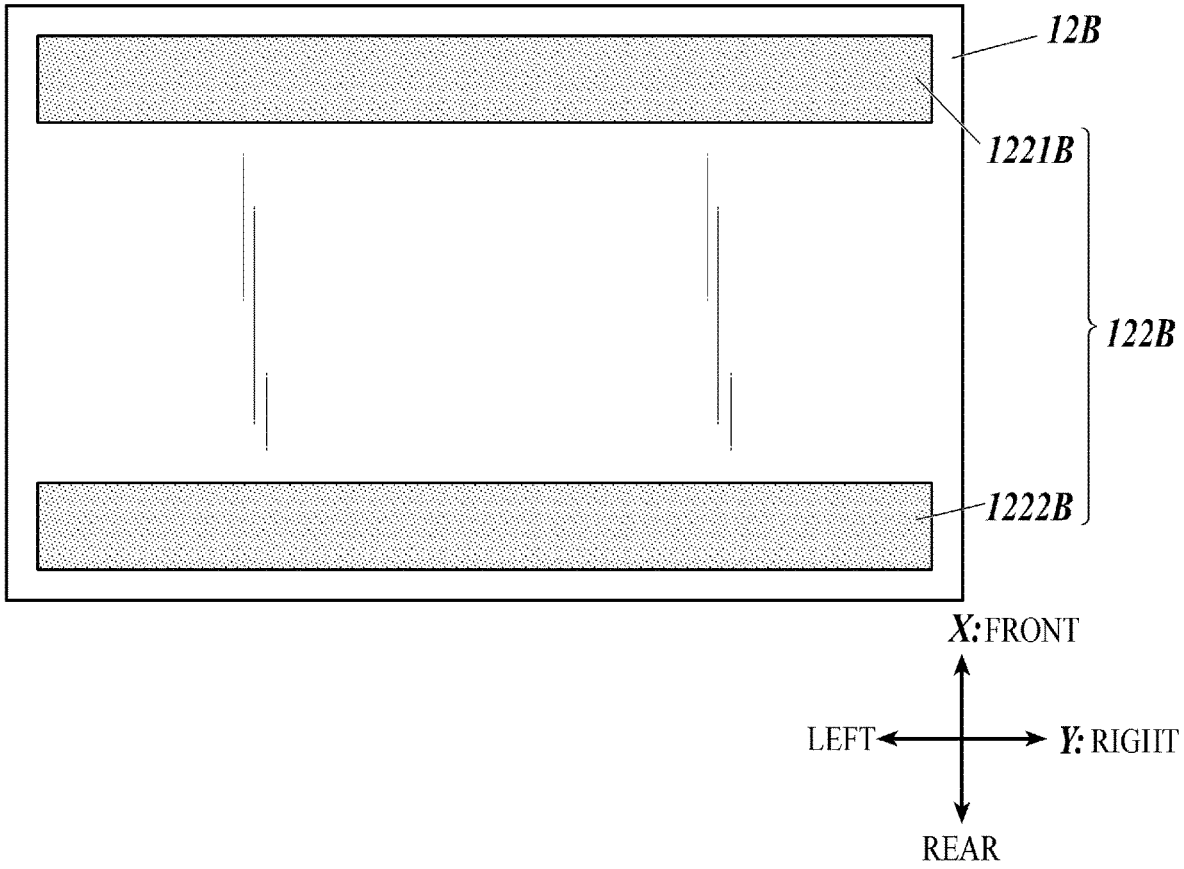
FIG. 15B is a bottom view of the home tissue paper accommodation container according to the modified embodiment of the placing portion.

Alternatively, as shown in FIG. 15A and FIG. 15B, there may be formed a placing portion 122B including a front placing portion 1221B that is formed near the front edge of the lower container body 12B extending in the left-right direction and a rear placing portion 1222B that is formed near the rear edge of the lower container body 12B extending in the left-right direction.

In this case, the placed home tissue paper accommodation container is less likely to slip in the front-rear direction than in the left-right direction. Such a home tissue paper accommodation container is suitable when it is highly necessary to prevent the container from slipping in the front-rear direction and when it is preferable that the container can be slid relatively easily in the left-right direction. For example, it is suitable when the placing surface is narrow in the front-rear direction and wide in the left-right direction.

Also in this case, as shown in FIG. 15A, the front placing portion 1221B and the rear placing portion 1222B are preferably formed such that the rear placing portion 1222B is higher than the front placing portion 1221B. The angle (θ in FIG. 15A) formed between the lower surface of the lower container body 12B excluding the placing portion 122B and the placing surface on which the home tissue paper accommodation container is placed is preferably 1° to 5°, more preferably 1° to 3°.

As shown in FIG. 3 to FIG. 15A, the lower surface of the front placing portion 1221B and the lower surface of the rear placing portion 1222B are formed to be located on the same plane as each other.

The front placing portion 1221B preferably has a height at the front edge of 0.5 mm to 10 mm in the z direction, and is formed such that its height at the rear edge is slightly higher than the height at the front edge. The rear placing portion 1222B preferably has a height at the rear edge of 10 mm to 20 mm in the z direction, and is formed such that its height at the front edge is slightly lower than the height at the rear edge. The height at the rear edge of the rear placing portion 1222B needs to be higher than the height at the front edge of the front placing portion 1221B.

Figure 16A:
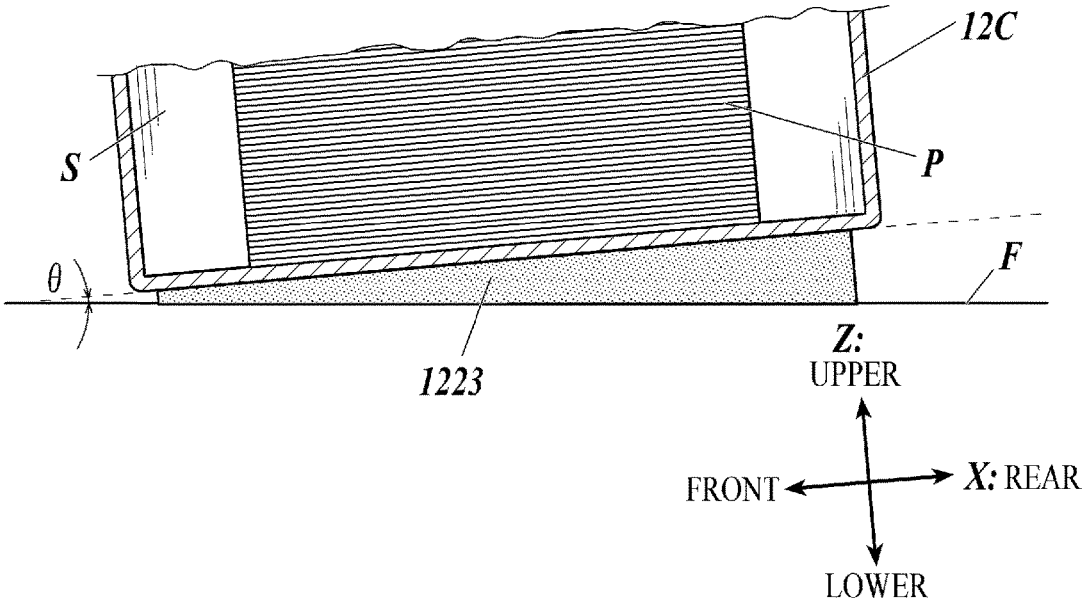
FIG. 16A is a sectional view of a home tissue paper accommodation container according to a modified embodiment of a placing portion, at a portion corresponding to FIG. 3 when an open/close lid is in a closing state. The upper part of the home tissue paper accommodation container is omitted in the drawing.
Figure 16B:
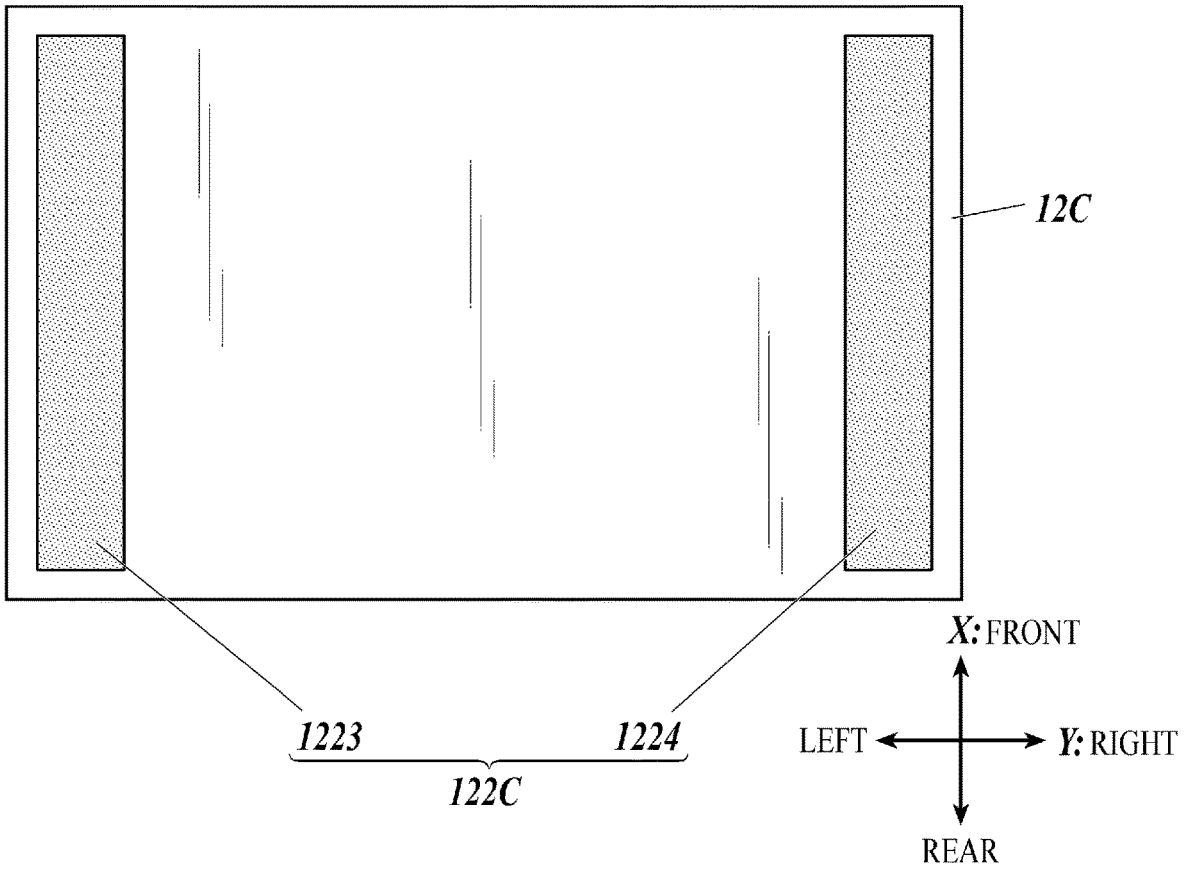
FIG. 16B is a bottom view of the home tissue paper accommodation container according to the modified embodiment of the placing portion.

Alternatively, as shown in FIG. 16A and FIG. 16B, there may be formed a placing portion 122C including a left placing portion 1223 that is formed near the left edge of the lower container body 12 extending in the front-rear direction and a right placing portion 1224 that is formed near the right edge of the lower container body 12 extending in the front-rear direction.

In this case, the placed home tissue paper accommodation container is less likely to slip in the left-right direction than in the front-rear direction. Such a home tissue paper accommodation container is suitable when it is highly necessary to prevent the container from slipping in the left-right direction and when it is preferable that the container can be slid relatively easily in the front-rear direction. For example, it is suitable when the placing surface is narrow in the left-right direction and wide in the front-rear direction.

In this case, as shown in FIG. 16A, each of the left placing portion 1223 and the right placing portion 1224 is preferably formed to have a rear edge higher than a front edge. The angle (θ in FIG. 16A) formed between the lower surface of the lower container body 12C excluding the placing portion 122C and the placing surface on which the home tissue paper accommodation container is placed is preferably 1° to 5°, more preferably 1° to 3°.

Preferably, the lower surface of the left placing portion 1223 and the lower surface of the right placing portion 1224 are formed to be located on the same plane as each other, each have a height at the front edge of 0.5 mm to 10 mm in the z direction, and each have a height at the rear edge of 10 mm to 20 mm in the z direction. The height at the rear edge of the left placing portion 1223 needs to be higher than the height at the front edge of the left placing portion 1223, and the height at the rear edge of the right placing portion 1224 needs to be higher than the height at the front edge of the right placing portion 1224.

Detailed configurations of the home tissue paper accommodation container 100 can be appropriately changed without departing from the gist of the present invention.

The present invention is suitably applied in a technical field of manufacturing a home tissue paper accommodation container.

The invention claimed is:

1. A home tissue paper accommodation container comprising:

a container body that has an accommodation space that is configured to accommodate home tissue paper therein, wherein:

the container body includes an upper container body that forms an upper part of the container body and a lower container body that forms a lower part of the container body, the upper container body and the lower container body are integrally formed and connected by at least one connection portion, the upper container body and the lower container body are detachably assembled, thereby closing the accommodation space, the connection portion connects respective outer surfaces of the upper container body and the lower container body, the surfaces facing in the same direction when the upper container body and the lower container body are assembled, the connection portion connects to the upper container body at a portion separated from a lower edge of the upper container body when the upper container body and the lower container body are assembled, the connection portion connects to the lower container body at a portion separated from an upper edge of the lower container body when the upper container body and the lower container body are assembled, and the connection portion lies substantially flat along the respective outer surfaces of the upper container body and the lower container body when the upper container body and the lower container body are assembled.

2. The home tissue paper accommodation container according to claim 1, wherein the connection portion has a length that is substantially the same as a total of: (i) a distance between a portion at which the connection portion connects to the upper container body and a lower edge of the upper container body when the upper container body and the lower container body are assembled, and (ii) a distance between a portion at which the connection portion connects to the lower container body and an upper edge of the lower container body when the upper container body and the lower container body are assembled.

3. The home tissue paper accommodation container according to claim 1, wherein the at least one connection portion is a plurality of connection portions.

4. The home tissue paper accommodation container according to claim 1, wherein the connection portion covers an entire outer surface of a contacting portion when the upper container body and the lower container body are assembled, the contacting portion being where a surface on which the connection portion connects to the upper container body is in contact with a surface on which the connection portion connects to the lower container body.

5. The home tissue paper accommodation container according to claim 1, wherein the connection portion includes a thick portion that extends in an upper-lower direction when the upper container body and the lower container body are assembled, and wherein, in the connection portion, the thick portion is thicker than a portion of the connection portion other than the thick portion.

6. The home tissue paper accommodation container according to claim 1, wherein the container body is formed of a hard material, the upper container body and the lower container body are connected by at least one connection portion that is on a rear side of the container body, the upper container body has an outlet and an open/close lid on an upper surface, the home tissue paper being taken out through the outlet, the open/close lid being connected to the container body and configured to cover the outlet and to be freely opened and closed, the lower container body has placing portions that are formed of an elastic material and protrude downward from a lower surface of the lower container body, and the placing portions include a front placing portion formed near a front edge of the lower surface and a rear placing portion formed near a rear edge of the lower surface and higher than the front placing portion.

* * * * *